US007140931B2

(12) United States Patent
Norman et al.

(10) Patent No.: US 7,140,931 B2
(45) Date of Patent: Nov. 28, 2006

(54) SYSTEM AND APPARATUS FOR IMPROVING SAFETY AND THRUST FROM A HYDRO-DRIVE DEVICE

(76) Inventors: George I. Norman, 358 S. 700 East, Suite 256, Salt Lake City, UT (US) 84102; Thomas W. Peterson, 1646 W. Allegheny Dr., Taylorville, UT (US) 84123

( * ) Notice: Subject to any disclaimer, the term of this patent is extended or adjusted under 35 U.S.C. 154(b) by 0 days.

(21) Appl. No.: 11/291,346

(22) Filed: Dec. 1, 2005

(65) Prior Publication Data

US 2006/0116033 A1 Jun. 1, 2006

Related U.S. Application Data

(63) Continuation-in-part of application No. 10/897,133, filed on Jul. 22, 2004, now Pat. No. 6,986,689.

(60) Provisional application No. 60/653,366, filed on Feb. 16, 2005, provisional application No. 60/646,470, filed on Jan. 24, 2005, provisional application No. 60/632,230, filed on Dec. 1, 2004.

(51) Int. Cl.
*B63H 1/16* (2006.01)

(52) U.S. Cl. ..... 440/67; 440/72

(58) Field of Classification Search ..... 440/66, 440/67, 70, 71, 72, 76
See application file for complete search history.

(56) References Cited

U.S. PATENT DOCUMENTS

| | | | | | |
|---|---|---|---|---|---|
| 4,637,801 | A | * | 1/1987 | Schultz | 440/67 |
| 4,680,017 | A | * | 7/1987 | Eller | 440/66 |
| 4,832,634 | A | * | 5/1989 | Kearns | 440/67 |
| 5,906,522 | A | * | 5/1999 | Hooper | 440/66 |
| 5,928,042 | A | * | 7/1999 | Quiggins | 440/72 |

* cited by examiner

*Primary Examiner*—Lars A. Olson
(74) *Attorney, Agent, or Firm*—Kunzler & Associates

(57) ABSTRACT

A system and apparatus are disclosed for improving safety and hydro-flow thrust from a hydro-drive device. The apparatus may include a shroud having a first opening for the ingress of water, and a second opening for the egress of water, a diverter connected with the shroud and angled in a direction selected to direct water to form a vortex as the water exits the shroud, and a screen connected with the second opening and configured to allow a substantially free flow of water and to prevent marine, plant, animal, and human life from contacting the hydro-drive device. The system may include a motor, a hydro-drive device coupled to the motor, and the apparatus.

26 Claims, 22 Drawing Sheets

SYSTEM AND APPARATUS FOR IMPROVING SAFETY AND THRUST FROM A HYDRO-DRIVE DEVICE

CROSS-REFERENCES TO RELATED APPLICATIONS

This application is a continuation in part of and claims benefit of U.S. patent application No. 10/897,133 entitled "SYSTEM AND APPARATUS FOR IMPROVING SAFETY AND THRUST FROM A HYDRO-DRIVE DEVICE," filed on Jul. 22, 2004 now U.S. Pat. No. 6,986,689 for George I. Norman, U.S. Provisional Patent Application No. 60/632,230 entitled "Enviroprop Suproguard" filed on Dec. 1, 2004 for George I. Norman, U.S. Provisional Patent Application No. 60/646,470 entitled "Enviroprop Hydro Vortex Diverters" filed on Jan. 24, 2005 for George I. Norman, and U.S. Provisional Patent Application No. 60/653,366 entitled "Enviroprop Hydro Vortex Diverters No. 2" filed on Feb. 16, 2005 for George I. Norman, each of which are incorporated herein by reference.

BACKGROUND OF THE INVENTION

1. Field of the Invention

This invention relates to marine propulsion devices such as outboard motors, stern drive units and the like, and more particularly relates to improving safety and hydro-flow thrust from hydro-drive devices.

2. Description of the Related Art

For over 100 years screwdriven propellers and impellers have been used to propel marine vehicles. Over the years, the technology of the propulsion drives has changed incredibly. However, the technology of the propeller/impeller, aside from sizes and shapes, has remained relatively unchanged.

As a propeller/impeller turns, water is drawn in and is accelerated through the flywheel action of a propeller/impeller increasing the higher-velocity stream of water behind (aft) the propeller/impeller. Accelerating the water by the action of pulling water in and pushing water out at a higher velocity is commonly known as adding momentum to the water. This change in momentum or acceleration of the water (hydro-flow) results in a force called "thrust." A curvature of the propeller/impeller blade creates low-pressure on the back of the blade, thus inducing lift, much like the wing on an airplane. With a marine propeller/impeller, the lift is translated into horizontal movement.

The spinning blades of the propeller/impeller produce hydro-flow thrust, which can depend upon many factors. Examples of such factors include volume of water accelerated per time unit, propeller/impeller diameter, velocity of incoming hydro-flow, density of water, and the SHP (shaft horsepower) accelerating the propeller/impeller. As in any motorized industry, great expense and effort is put into the improvement of efficiency and power of the motor. Perhaps the largest factor relating to efficiency and power or hydro-flow thrust is the propeller/impeller.

The propeller shroud also has the additional benefit of protecting submerged objects from contact with the propeller/impeller. With ever increasing marine vehicle ownership, incidents of injury or damage due to propeller/impellers strikes, though unfortunate, seem commonplace. The shroud prevents swimmers, water skiers, water sports enthusiast, and marine life from encountering or being entangled by the spinning blades of a propeller/impeller. Safety is accomplished by enclosing the entire flywheel area of the propeller/impeller within the propeller shroud.

Shrouds are available that may perform the function of protecting people, marine sea and plant life from the propeller/impeller. However, available shrouds tend to restrict water flow, increase drag, or modify the exiting water stream. Each of the aforementioned actions appreciably reduces hydro-flow thrust, thus negatively affecting the performance.

From the foregoing discussion, it should be apparent that a need exists for a system and apparatus that protects people, marine and plant life, and increases hydro-flow thrust generated from a boat propeller/impeller. Beneficially, such a system and apparatus would increase hydro-flow, decrease drag, and improve performance by increasing the volume and velocity of hydro-flow thrust in a vortex exiting the shroud

SUMMARY OF THE INVENTION

The present invention has been developed in response to the present state of the art, and in particular, in response to the problems and needs in the art that have not yet been fully solved by currently available hydro-drive device thrust enhancement systems. Accordingly, the present invention has been developed to provide a system and apparatus for improving thrust from a hydro-drive device that overcome many or all of the above-discussed shortcomings in the art.

The apparatus to improve thrust may include a shroud having a first opening for the ingress of water, and a second opening for the egress of water, and a diverter or diverters connected with the shroud and angled in a direction selected to direct water to form a vortex as the water exits the shroud. In one embodiment, the apparatus also includes a screen connected with the second opening and configured to allow a substantially free flow of water and to prevent marine, plant, animal, and human life from contacting the hydro-drive device.

In one instance, the screen is formed substantially from a semi-rigid material selected from the group consisting of metal-based mesh, polymer-based mesh, composite-based mesh, and ceramic-based mesh. Alternatively, the screen maybe formed substantially from a flexible polymeric material.

In one embodiment, the screen is configured to completely cover the second opening while allowing the substantially free flow of water. In one example, the screen further comprises a collar configured to form an opening in the screen so as to allow objects to exit the shroud. The screen may be formed having a conical shape extending outward from the shroud, or the screen may be formed having a convex shape extending outward from the shroud.

In a further embodiment, the screen is formed having a cylindrical shape extending outward from the shroud configured to prevent marine, plant, animal, and human life from contacting a second hydro-drive device. Furthermore, the screen further comprises a conical screen portion coupled with the cylindrical shape. The apparatus may also include a mounting plate coupled to an outside surface of the shroud, the mounting plate configured to couple the shroud to a vehicle, and a skeg coupler connected to the exterior surface of the shroud, the skeg coupler configured to slidably couple to a skeg of the marine vehicle. The apparatus may also include a screen coupled with the first opening configured to prevent objects from being drawn into the shroud.

A system of the present invention is also presented for directing fluid from a hydro-drive device. Particularly, the system may include a motor configured to propel a vehicle, a hydro-drive device coupled to the motor, and the apparatus coupled with the vehicle.

Reference throughout this specification to features, advantages, or similar language does not imply that all of the features and advantages that may be realized with the present invention, should be, or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are given to provide a thorough understanding of embodiments of the invention.

One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
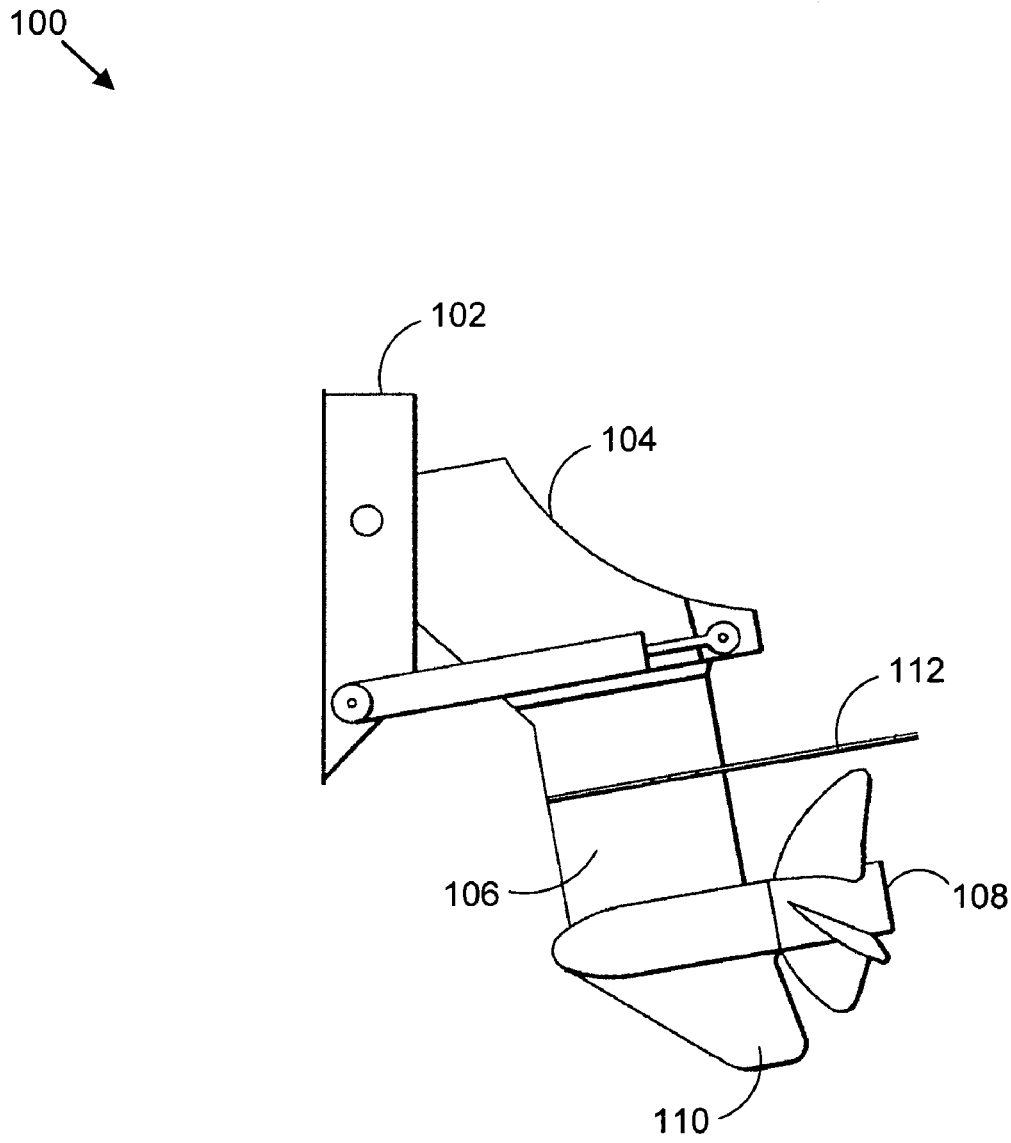
FIG. 1 is a side view of one embodiment of a system for moving a marine vehicle in accordance with the prior art.

FIG. 1 is a side view of one embodiment of a system 100 for moving a marine vehicle in accordance with the prior art. The system 100 may include a transom mount assembly 102 for connecting the system 100 to a stem or transom of a boat (not shown). The transom mount assembly 102 is configured to transfer power from a motor to an upper gear case assembly 104. The upper gear case assembly 104 directs the power through a drive shaft (not shown) to the lower unit 106 and in turn to a hydro-drive device 108. The system 100 may also include a skeg 110 and a cavitation plate 112 (also referred to as "anticavitation plate" or "antiventillation plate"). The cavitation plate 112 prevents surface air from reaching the hydro-drive device 108.

Figure 2:
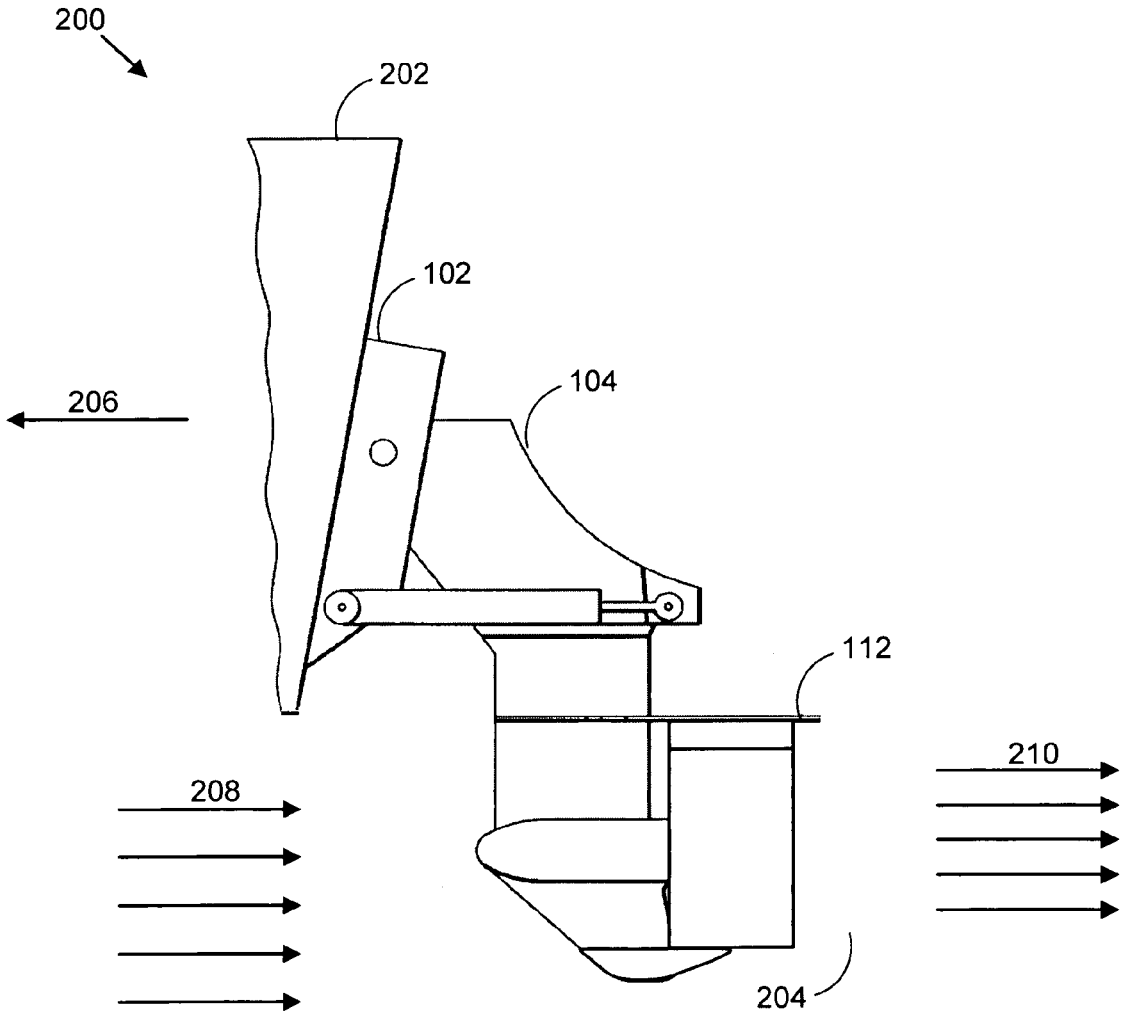
FIG. 2 is a partially schematic side view diagram graphically illustrating one embodiment of a system for moving a marine vehicle in accordance with the present invention.

FIG. 2 is a partially schematic side view diagram graphically illustrating one embodiment of a system 200 for moving a marine vehicle in accordance with the present invention. The system 200 may include the stem of the boat 202 connected to the transom mount assembly 102 as described above with reference to FIG. 1. Additionally, the system 200 may comprise a shroud 204 configured to at least partially enclose the hydro-drive device. In one embodiment, the shroud 204 is coupled to the cavitation plate 112 and the skeg 110. As used herein, the term "shroud" refers to a substantially cylindrical device for at least partially circumferentially enclosing the hydro-drive device 108. The shroud 204 is formed from a substantially solid side wall around the hydro-drive device 108. The side wall protects the hydro-drive device 108 and directs the flow of water from the hydro-drive device 108 as will be described below.

The depicted embodiment illustrates the shroud 204 coupled to a stern-drive system. Alternatively, the shroud 204 may be similarly coupled to outboard motor assemblies, inboard motor assemblies, jet propelled vehicles such as personal water craft, and other marine drive assemblies having hydro-drive devices 108. As used herein, the term "hydro-drive device" refers to any marine vehicle thrust inducing device such as, but not limited to, propellers, impellers, and the like.

The system 200 is configured to enable the boat 202 to move about in water. The boat 202 may move in both a forward direction represented by arrow 206 and a reverse direction. The gear case assembly 104 is mounted for pivotal movement about a vertical axis to enable the boat to turn. As the boat 202 moves through water, water enters the shroud 204 in a direction illustrated by arrows 208 and exits in a direction indicated by arrows 210. The shroud 204 may comprise a first opening 302 (shown in FIG. 3) configured to allow the unrestricted ingress of water, and a second opening 304 (shown in FIG. 3) for the egress of water.

Figure 3:
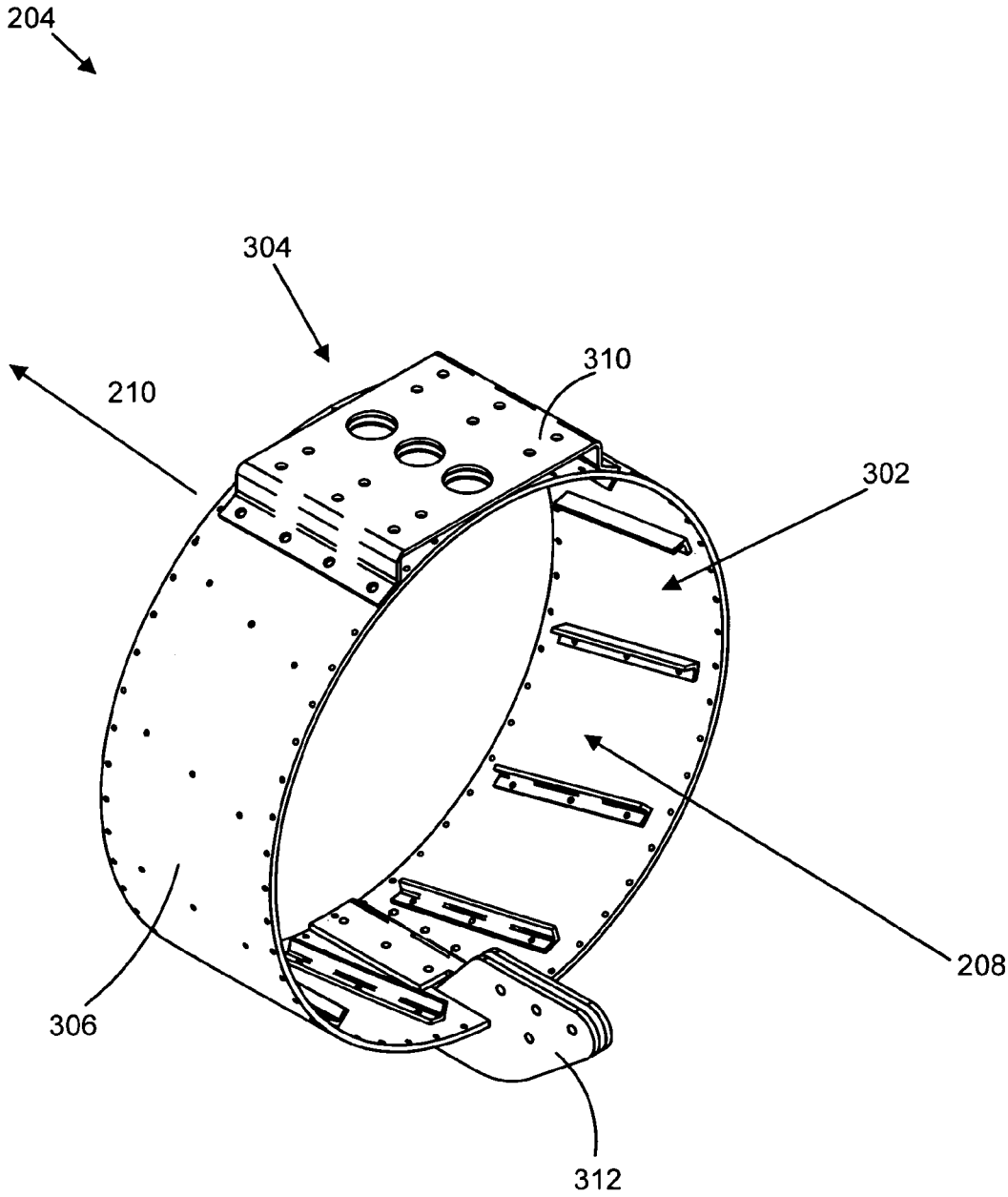
FIG. 3 is a perspective view shown from the top and to one side and illustrating one embodiment of the shroud in accordance with the present invention.

FIG. 3 is a perspective view shown from the top and to one side and illustrating one embodiment of the shroud 204 in accordance with the present invention. The shroud 204 may comprise a substantially tubular cylinder having the first opening 302 and the second opening 304. The shroud 204 is configured to at least partially circumferentially enclose the hydro-drive device 108 in a cylindrical region 306. The first opening 302 may have a diameter slightly larger than the hydro-drive device 108 in order to circumferentially enclose the hydro-drive device. The cylindrical region 306 may alternatively completely circumferentially enclose the hydro-drive device 108 thereby protecting swimmers, water skiers, water sports enthusiast, and marine life from encountering or being entangled by the hydro-drive device 108.

The shroud 204 may also include a mounting plate 310 for connecting the shroud 204 to the cavitation plate 112, and a skeg coupler 312 for securing the shroud 204 to the skeg 110. Fastening devices (not shown) may include standard nuts and bolts. Alternatively, a keyed fastening device may be used when connecting the skeg coupler 312 to the skeg 110 in order to prevent theft of the shroud 204 and the hydro-drive device 108.

The shroud 204 may be formed of a light-weight metallic based material such as, but not limited to, aluminum alloys, steel alloys, titanium alloys, or the like. Additionally, the shroud 204 may be formed of composite materials including carbon fiber, high-impact plastics, or fiberglass. Depending upon the material used, the shroud may be pressed, rolled, injection molded, rotation molded, thermoformed, layed-up, spun, or extruded. Different finishes may also be applied to a surface of the shroud 204 in order to reduce drag and form a protective layer. The shroud 204 may be formed of discrete pieces, each forming a portion of the circumference of the shroud 204 and fastened together by a means such as welding or riveting.

Figure 4:
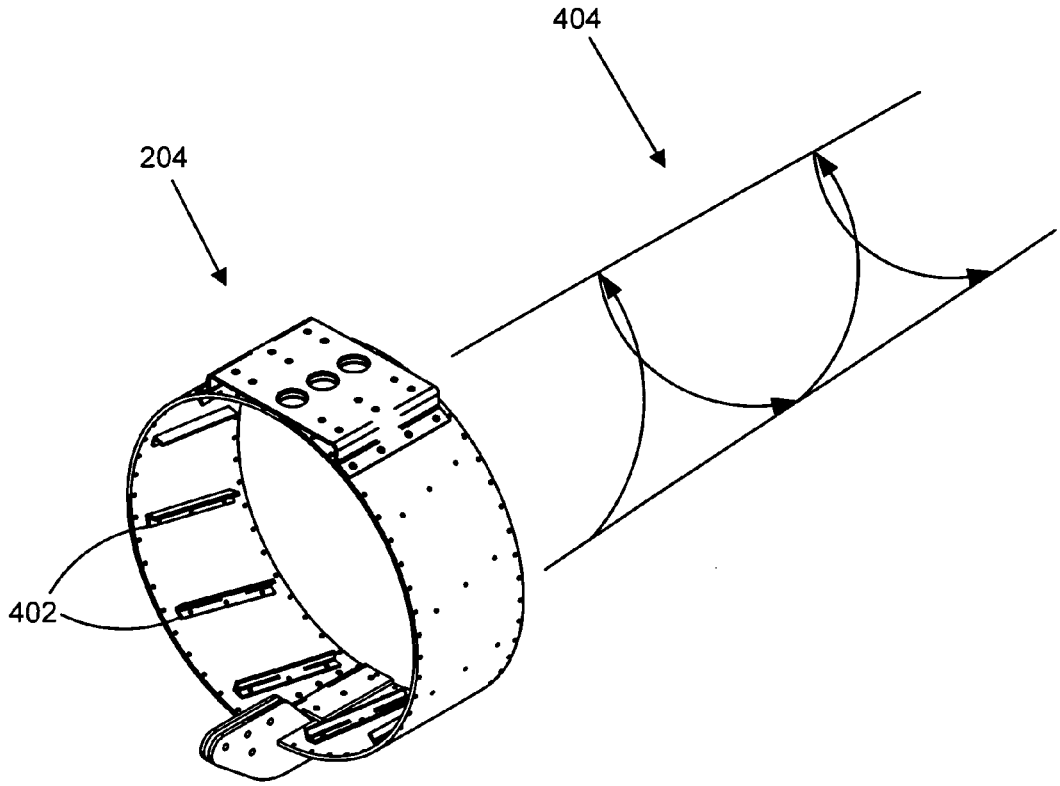
FIG. 4 is a perspective view diagram illustrating one embodiment of the shroud having a plurality of hydroflow vortex diverters for directing fluid to form a vortex 404 as the water exits the shroud in accordance with the present invention.

FIG. 4 is a perspective view diagram illustrating one embodiment of the shroud 204 having a plurality of hydroflow vortex diverters 402 for directing fluid to form a vortex 404 as the water exits the shroud 204. As used herein the term "hydroflow vortex diverter" refers to any device configured to direct water to form a vortex as the water exits the shroud 204 through the second opening 304. The hydroflow vortex diverter (hereinafter "diverter") 402 may comprise a device having a substantially flat surface for directing the flow 404 of water to form a vortex. Examples of diverters 402 may include, but are not limited to, vanes, blades, and/or fins. Alternatively, the shroud 204 may comprise a single diverter 402 for directing fluid to form a vortex 404. As used herein, the term "vortex" refers to fluid flow involving rotation about an axis.

Each diverter 402 may extend inward from an interior surface of the shroud 204, and extend longitudinally towards the second opening 304. Additionally, the diverters 402 are in one embodiment angled in such a way as to induce and/or enhance the vortex 404 formed by the hydro-drive device 108. In an alternative embodiment, the diverters 402 may be configured as grooves or channels (not shown) formed in the interior surface 410 of the shroud 204 and angled to direct water to enhance the vortex 404. The diverter 402 may be riveted, welded, bolted, attached using adhesive, or the like.

In a further embodiment, the diverter 402 may be formed of a ceramic material, composite material, or a high-impact rigid plastic. In one embodiment, the diverter 402 is configured with a curve to direct water to form a vortex as described above with reference to FIG. 4. The diverter 402 may be angled to form counter-clockwise or clockwise vortices depending upon the direction of rotation of the hydro-drive device 108.

Figure 5A:
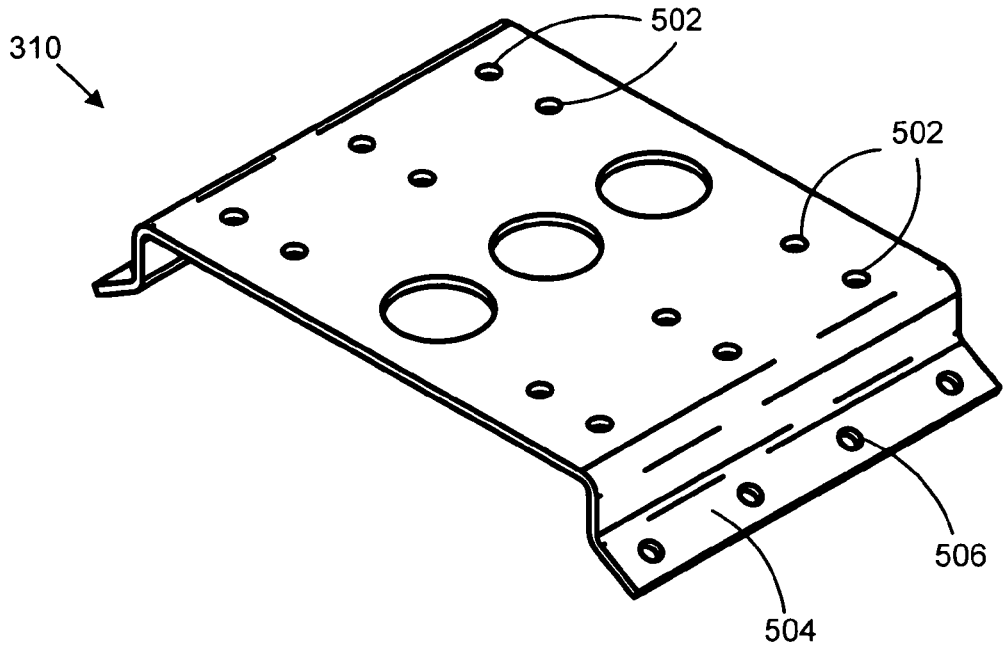
FIG. 5*a* is a side and top perspective view graphically illustrating one embodiment of the mounting plate in accordance with the present invention.

FIG. 5*a* is a side and top perspective view graphically illustrating one embodiment of the mounting plate 310 in accordance with the present invention. In one embodiment, the mounting plate 310 is configured to mount to the cavitation plate 112 of an outboard or stern drive motor housing. The mounting plate 310 is configured with a plurality of holes 502 for receiving fastening devices for coupling the mounting plate 310 to the cavitation plate 112. In a further embodiment, the mounting plate 310 may be configured to engage any flat surface such as a boat bottom, thereby enabling the shroud 204 to be mounted to marine vehicles that do not employ outboard motor housings such as, but not limited to tugboats, cruise ships, ocean cargo ships, and personal water craft.

Tabs 504 may be positioned having an angle sufficient for interfacing with the curvature of the shroud 204. The tabs 504 may be configured with a plurality of holes 506 configured to receive fastening devices. In one embodiment, the fastening devices (not shown) comprise rivets.

Figure 5B:
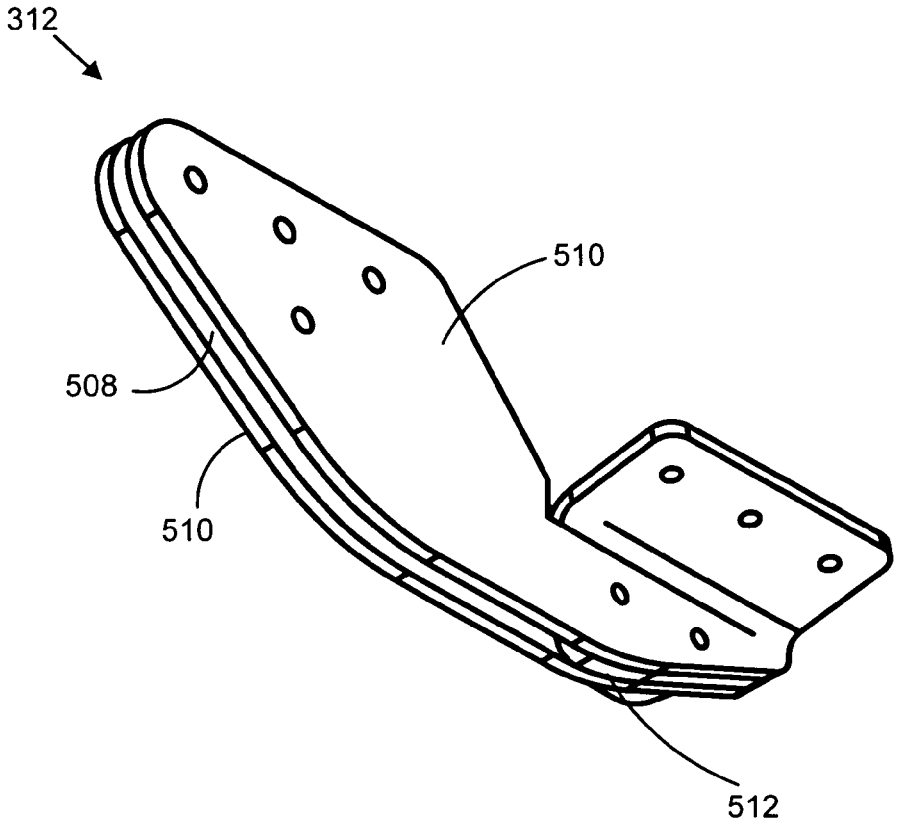
FIG. 5*b* is a bottom and side perspective view diagram illustrating one embodiment of the skeg coupler in accordance with the present invention.

FIG. 5*b* is a bottom and side perspective view diagram illustrating one embodiment of the skeg coupler 312 in accordance with the present invention. In one embodiment, the skeg coupler 312 comprises a slot 508 for receiving the skeg 110 of the outboard system 100. Alternatively, the slot 508 may receive the skeg of non-outboard marine drive systems. Once the skeg coupler 312 has been attached to the skeg 110, a unique fastener, such as a bolt, with a unique key may be locked in place in order to prevent theft of the hydro-drive device 108 or the shroud 204. In one embodiment, the skeg coupler 312 may comprise first and second sections 510 configured to engage a spacer 512. Alternatively, the skeg coupler 312 may be formed as a single unitary device.

Figure 6A:
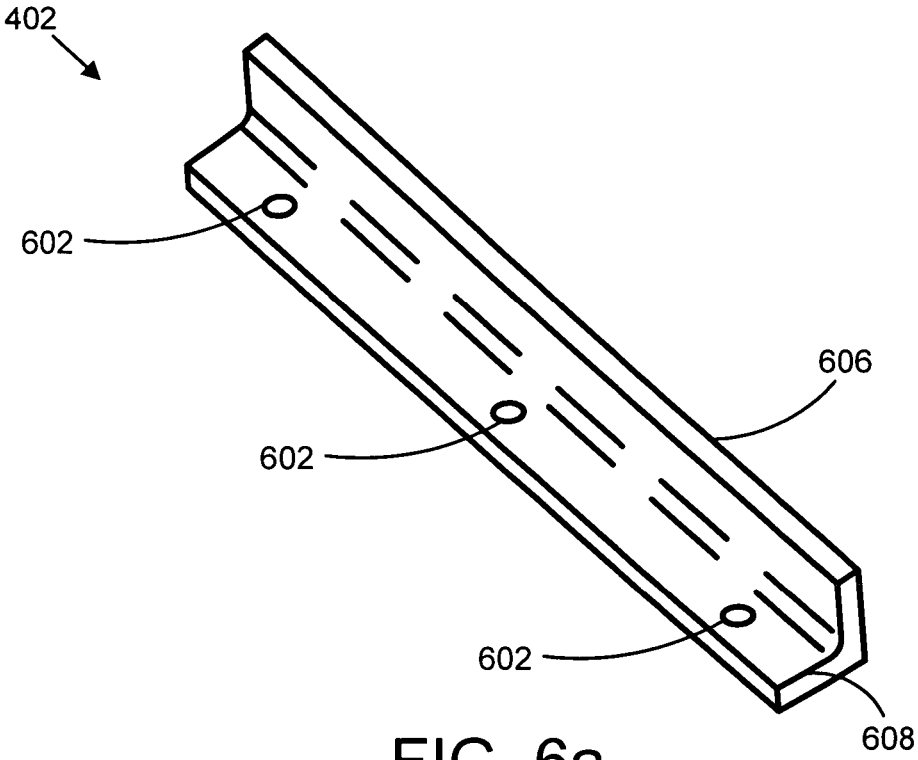
FIG. 6*a* is a perspective view diagram illustrating one embodiment of a diverter in accordance with the present invention.

FIG. 6*a* is a perspective view diagram illustrating one embodiment of a diverter 402 in accordance with the present invention. In one embodiment, the diverter 402 may comprise a length of 'L' shaped material. The diverter 402 maybe formed of a metal or rigid plastic. As depicted, the diverter 402 is substantially linear. In an alternative embodiment, the diverter 402 may be formed with a curve substantially similar to the interior curvature of the shroud 204 in order to interface with an interior surface of the shroud 204.

The diverter 402 is configured with a plurality of holes 602 for connecting the diverter 402 with the shroud 204. The diverter 402 may be permanently affixed to the shroud, or alternatively removably coupled with the shroud 204. For example, the diverter 402 may be welded to the shroud 204. Alternatively, the diverter 402 may be riveted to the shroud 204. In a further embodiment, the diverter 402 may be integrally formed with the shroud 204.

Figure 6B:
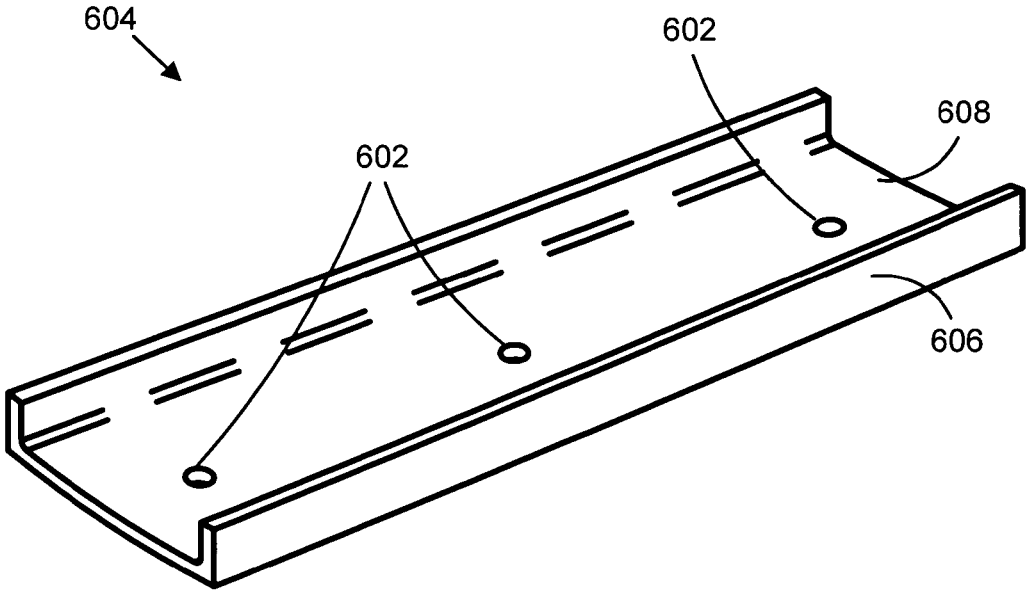
FIG. 6*b* is a perspective view diagram illustrating an alternative embodiment of a diverter in accordance with the present invention.

FIG. 6*b* is a perspective view diagram illustrating an alternative embodiment of a diverter 604 in accordance with the present invention. In one embodiment, the diverter 604 comprises a length of 'u' or 'c' channel. Both the diverter 402 of FIG. 6*a* and the diverter 604 may be configured with a vane 606 extending at a substantially right angle away from a base 608. Alternatively, the vane 606 may extend at an angle selected to optimally direct water to form a vortex. The vane 606 functions as a blade or fin in order to direct water according to the orientation of the diverter 402, 604 with relation to the shroud 204. In one embodiment, a plurality of diverters is arranged in a manner configured to form a clock-wise or alternatively a counter-clockwise vortex, depending upon the direction of rotation of the hydro-drive device 108.

Figure 7:
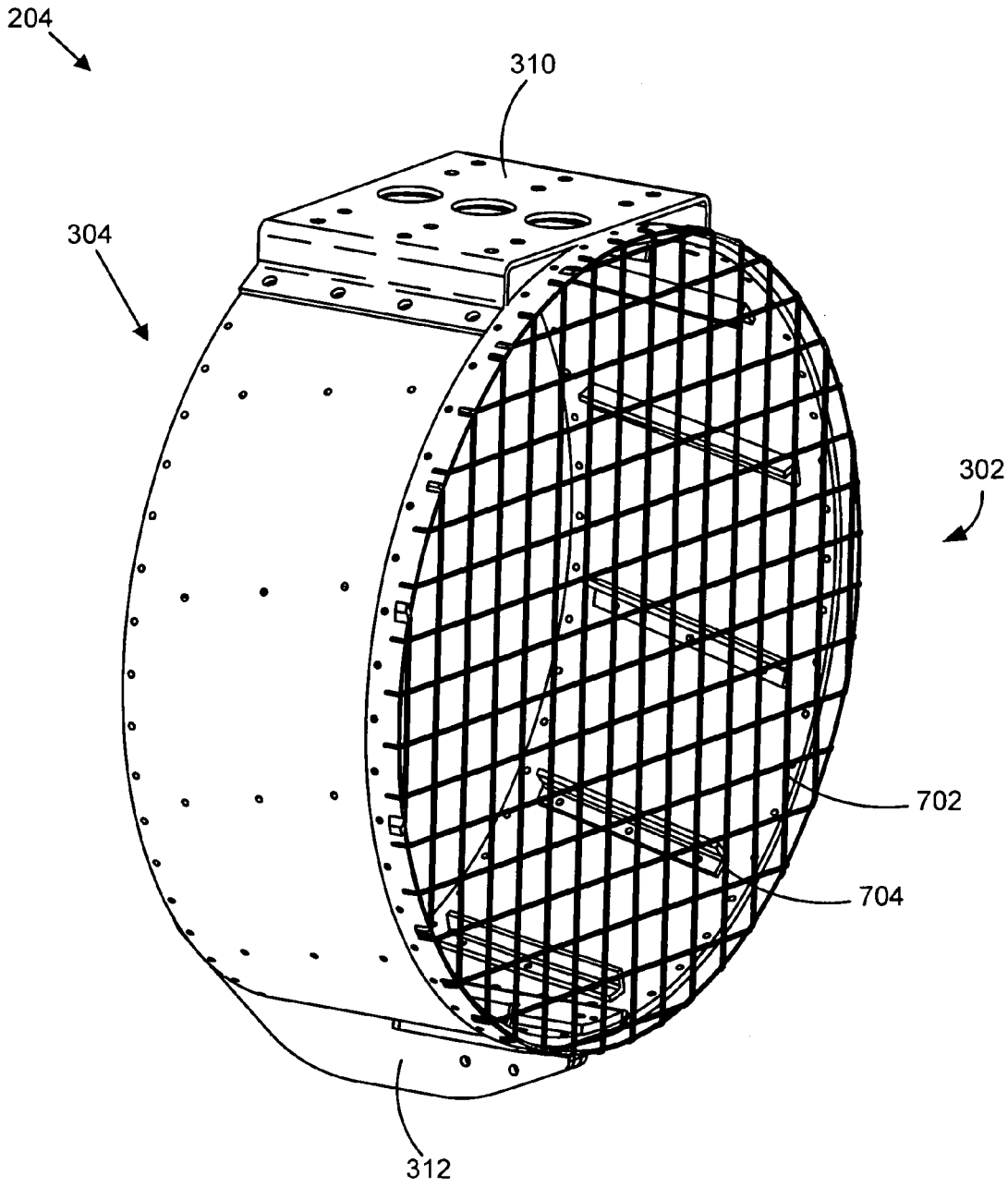
FIG. 7 is a perspective view diagram illustrating one embodiment of the shroud having a screen in accordance with the present invention.

FIG. 7 is a perspective view diagram illustrating one embodiment of the shroud 204 having a screen 702 in accordance with the present invention. As used herein, the term "screen" refers to a device, flexible or rigid, configured to allow the substantial free flow of water while preventing objects such as vegetation, marine, and human life from coming in contact with the hydro-drive device 108. The screen, as used herein, may comprise flexible elongated members such as strings or laces, or a rigid mesh formed of metals, plastics, composites, or ceramics. The screen may be formed of interwoven members, and alternatively may comprise horizontal or vertical members. In one embodiment, the shroud 204 includes a screen 702 coupled with the shroud 204 and covering the second opening 302. The second opening 302 may also be referred to as the "aft opening." As used herein, the term "aft opening" refers to the opening in the shroud 204 that faces away from the rear of the boat. Additionally, the first opening 304 may be referred to as the "fore opening" or the opening that faces toward the front of the boat.

The screen 702 may be formed with overlapping or interleaved elongated members, and in one embodiment, the elongated members comprise a plurality of strings 704. The strings 704 may be interwoven in a manner similar to the strings of a tennis racquet. In this and other embodiments, the strings 704 may be formed of a flexible polymeric material such as a nylon string. The nylon string may be a 15 or 16 gauge nylon string, similar to the string used in tennis racquets. Alternatively, metal strips or thin metal wire may be utilized to form the elongated members. In one embodiment, the elongated members 704 of the screen 702 are criss-crossed and not woven. Any other manner forming the screen may be used, including molding, welding, bolting, etc. The elongated members 704 may be formed of any suitable material. The screen 702 is configured to provide substantially free flow of water and prevent marine, plant, animal, and human life from contacting the hydro-drive device.

Figure 8:
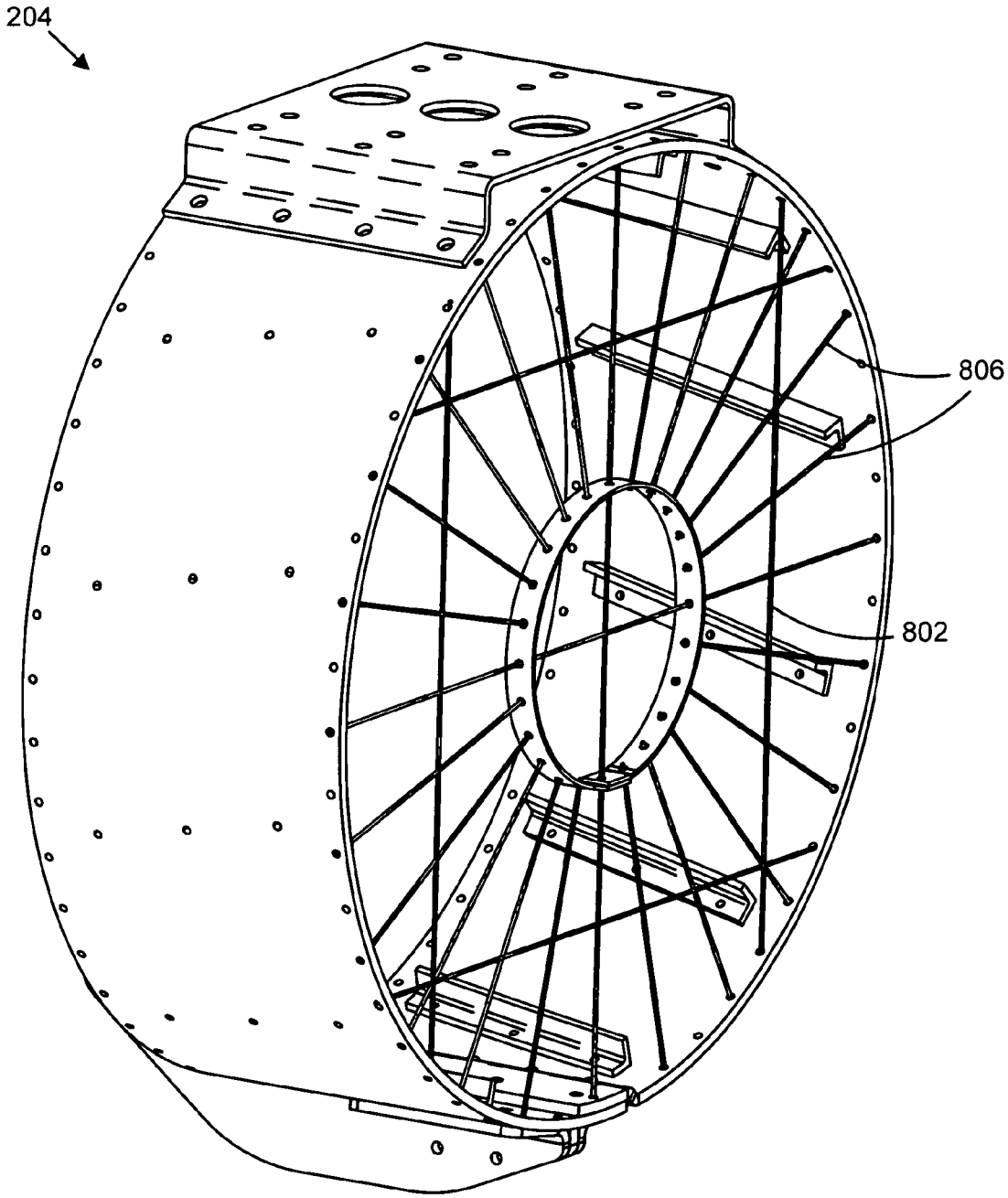
FIG. 8 is a perspective view diagram illustrating an alternative embodiment of a screen in accordance with the present invention.

FIG. 8 is a perspective view diagram illustrating an alternative embodiment of a screen 802 in accordance with the present invention. In one embodiment, the screen 802 is configured with a collar 804 configured to form an opening in the screen 802. The collar 804 is configured to allow objects such as vegetation to exit the shroud 204. Strings 806 extend outward radially from the collar 804 to the shroud 204. Additionally, a plurality of strings 806 may run vertically and horizontally through the radially extending strings 802 in order to provide additional strength to the screen 802. One benefit of the depicted embodiment is the ability of a user to replace strings 806 in a manner similar to the replacement of tennis racquet strings.

Figure 9:
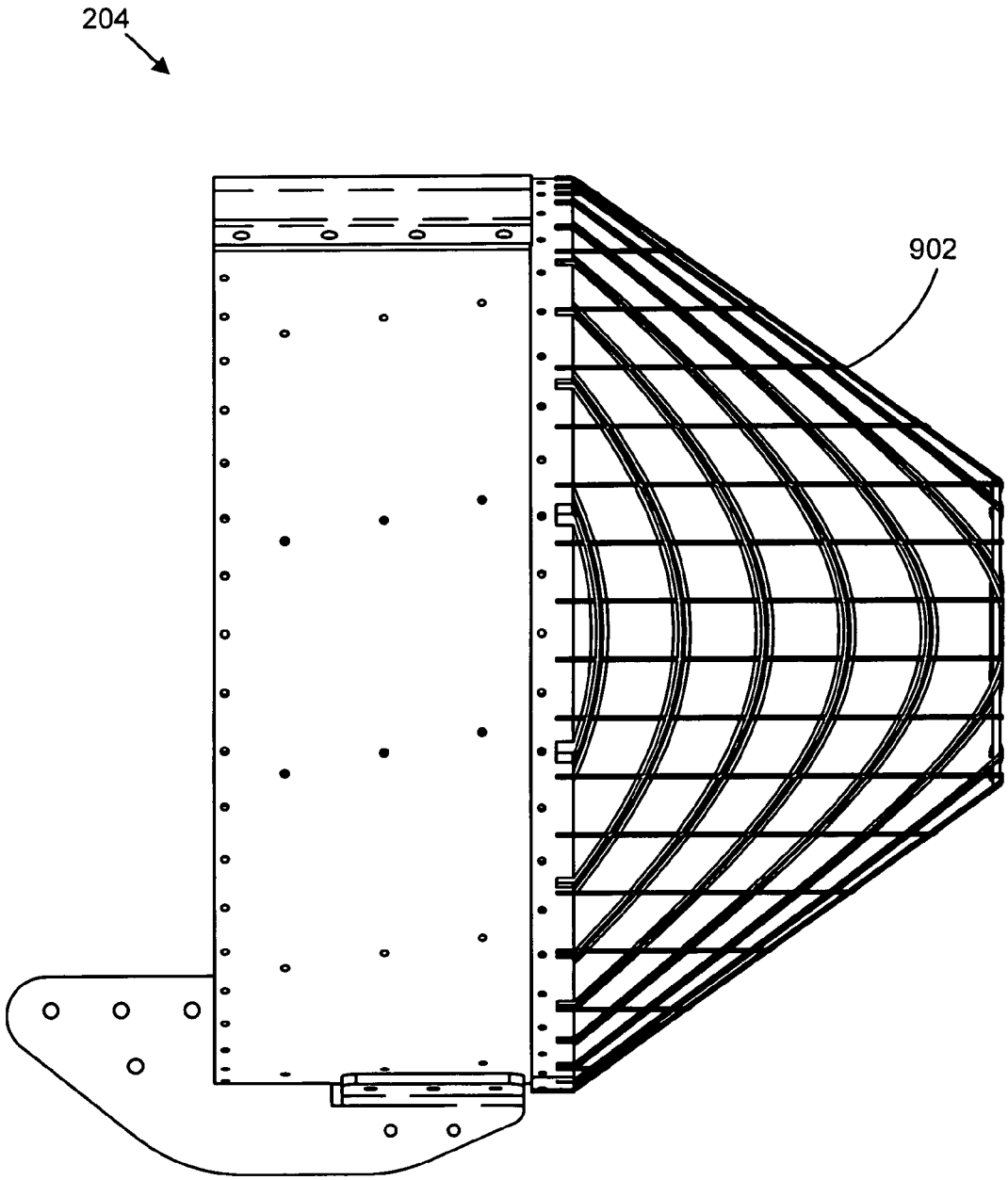
FIG. 9 is a side view illustrating one embodiment of the shroud having a conical screen in accordance with the present invention.

FIG. 9 is a side view illustrating one embodiment of the shroud 204 having a conical screen 902. In one embodiment, the screen 902 is formed with elongated members in the form of a rigid mesh. In one example, the elongated members are formed of metal such as expanded sheet metal. Furthermore, the screen 902 may be formed of stainless steel, for instance. The screen 902 may be formed of a sheet of mesh rolled to form the conical screen 902 as depicted.

Figure 10:
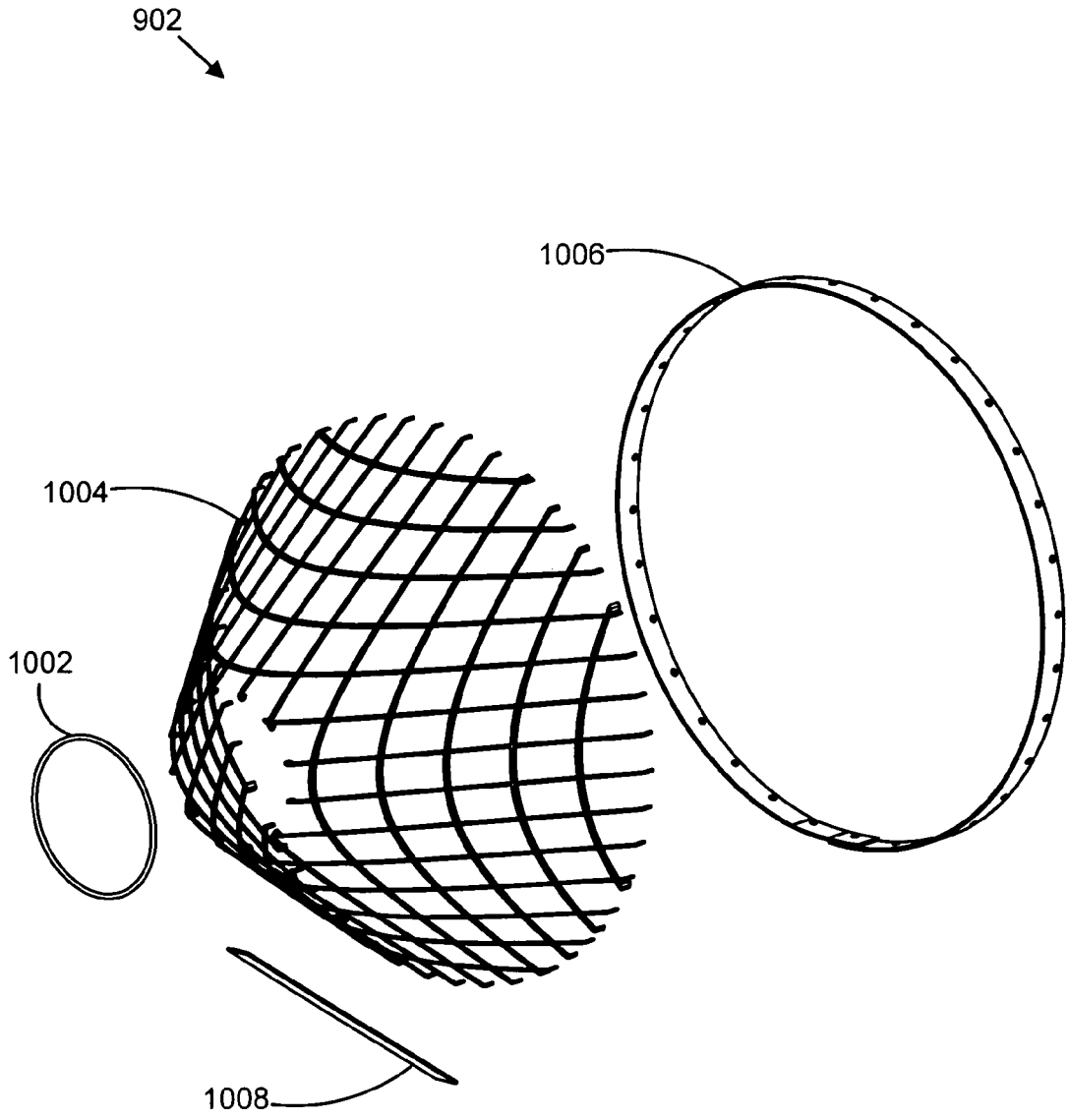
FIG. 10 is an exploded view diagram illustrating one embodiment of the conical screen in accordance with the present invention.

FIG. 10 is an exploded view diagram illustrating one embodiment of the conical screen 902 in accordance with the present invention. In one embodiment, the conical screen 902 comprises a collar 1002, a mesh 1004, a support ring 1006, and a support bar 1008. The mesh 1004, as described above, may be formed of metal and therefore welded to form the conical shape of the conical screen 902. In order to increase the strength of the conical screen 902, the individual metal strands may be interwoven and each intersection of the mesh 1004 may be spot welded.

The support bar 1008, in one embodiment, is welded to a seam of the mesh 1004 in order to increase strength. Additionally, the mesh 1004 is coupled with the collar 1002 and the support ring 1006. The mesh 1004 may likewise be welded to the collar 1002 and the support ring 1006. In a further embodiment, the support ring is coupled with the shroud 204.

Figure 11:
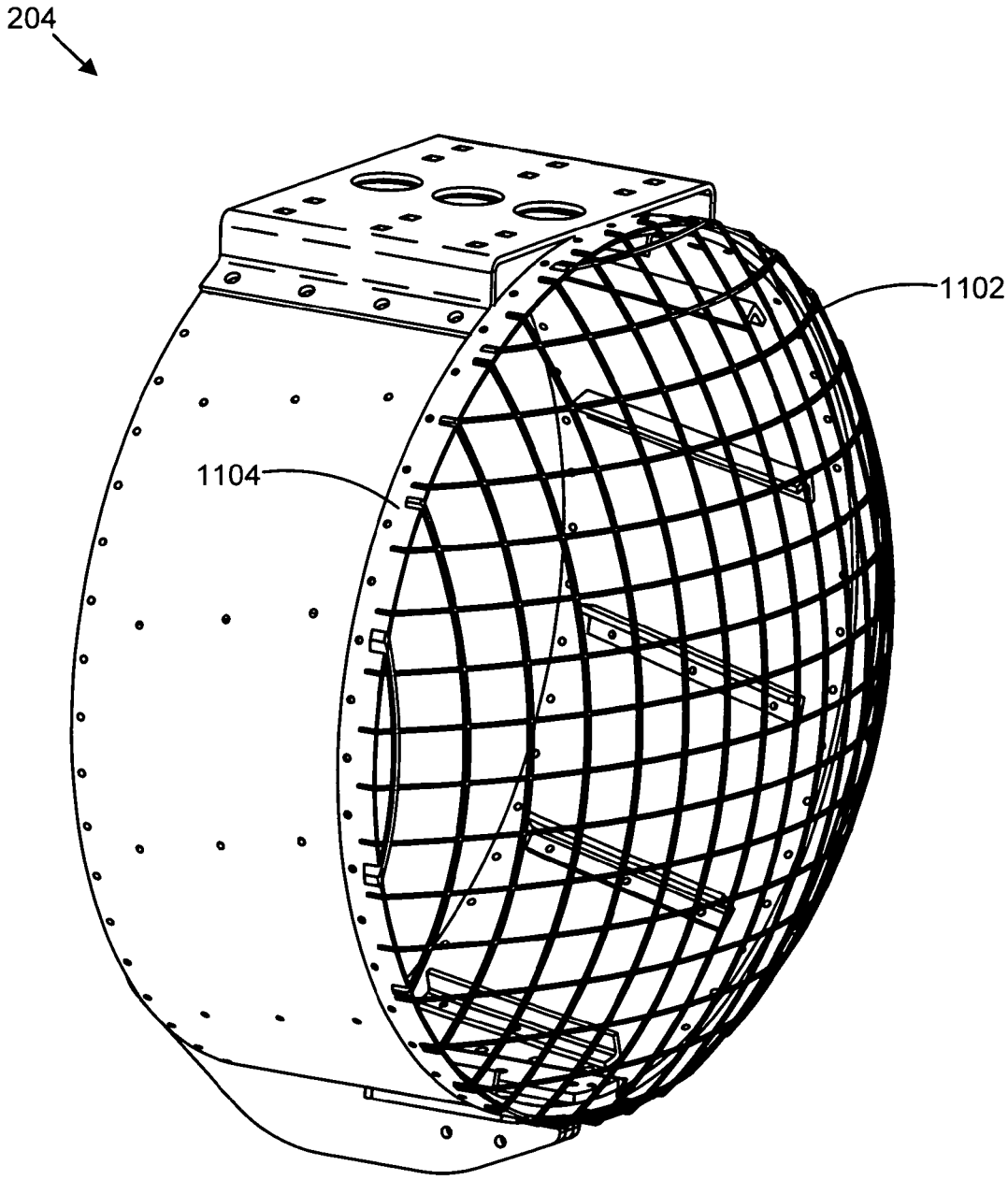
FIG. 11 is a perspective view diagram illustrating an alternative embodiment of the shroud having a convex screen in accordance with the present invention.

FIG. 11 is a perspective view diagram illustrating an alternative embodiment of the shroud 204 having a convex screen 1102 in accordance with the present invention. As used herein, the term "convex screen" refers to a screen having an outward curvature. In other terms, the screen 1102 "bulges" away from the aft opening of the shroud 204. The screen 1102 may be formed of a substantially rigid material so that the screen 1102 retains a convex shape.

The screen 1102 may be formed of a metal mesh as described above. The convex screen 1102 may be connected with a support ring 1104, which in turn is coupled with the shroud 204. The convex screen 1102 may be welded with the support ring 1104. Alternatively the convex screen 1102 may be attached using an adhesive, or the convex screen 1102 may be integrally formed with the support ring 1104. One benefit of the convex screen 1102 is an increased surface area through which water may flow. An increased surface area beneficially allows a greater flow of water.

Figure 12:
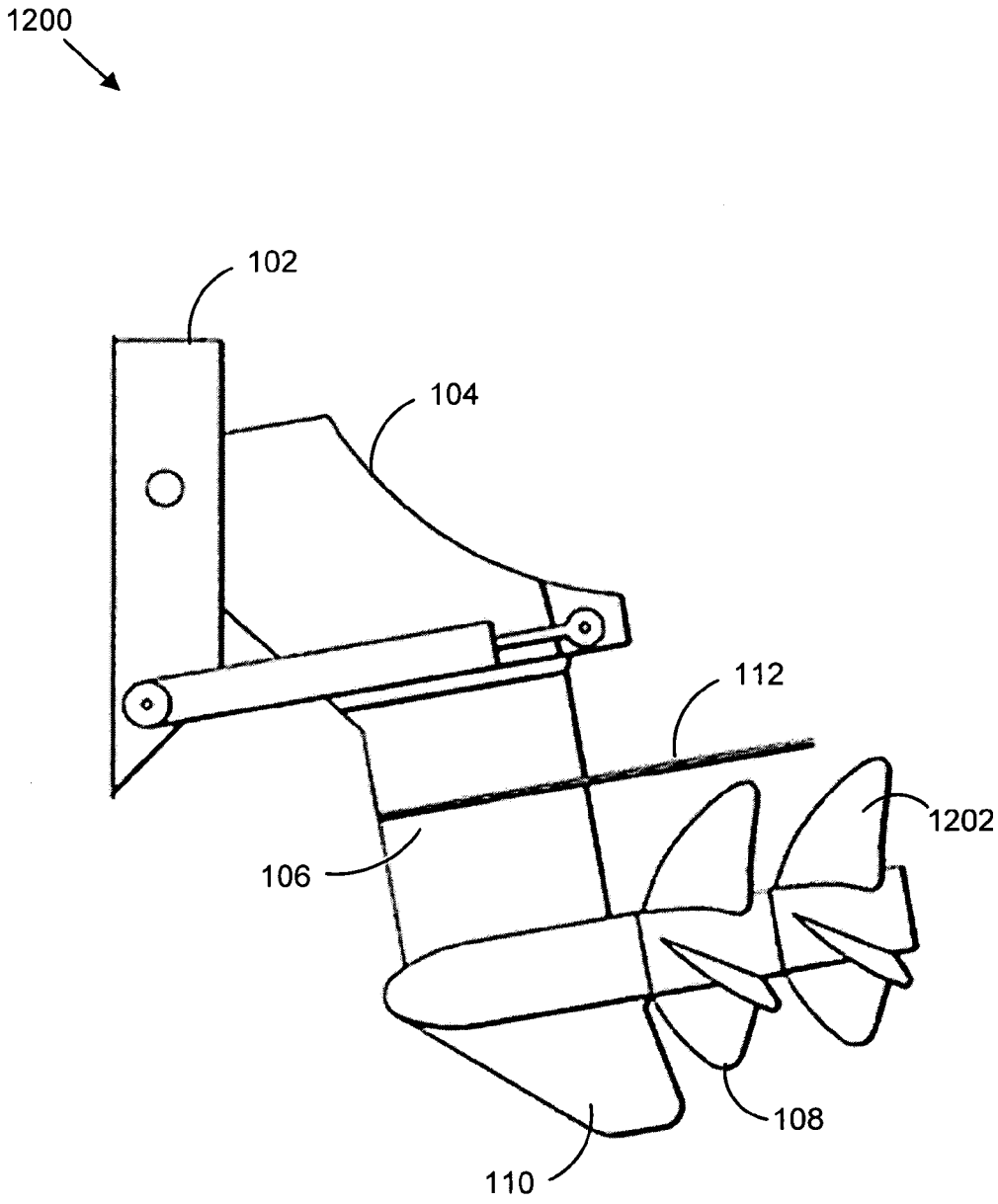
FIG. 12 (Prior Art)
FIG. 12 is a schematic block diagram illustrating one embodiment of a system in accordance with the prior art.

FIG. 12 is a schematic block diagram illustrating one embodiment of a system 1200 in accordance with the prior art. The system 1200 is similar to the system 100 of FIG. 1 described above in that the system 122 includes a transom mount assembly 102 for connecting the system 100 to a stern or transom of a boat (not shown). The transom mount assembly 102 is configured to transfer power from a motor to an upper gear case assembly 104. The upper gear case assembly 104 directs the power through a drive shaft (not shown) to the lower unit 106 and in turn to a hydro-drive device 108. The system 100 may also include a skeg 110 and a cavitation plate 112 (also referred to as "anticavitation plate" or "antiventillation plate"). The cavitation plate 112 prevents surface air from reaching the hydro-drive device 108.

In one embodiment, the system 1200 includes a second hydro-drive device 1202. The depicted embodiment is often referred to as a "dual prop" setup. In other terms, multiple hydro-drive devices 108, 1202, or propellers, may be implemented on a common outdrive. Typically the second propeller 1202 rotates in a direction opposite the direction the first propeller 108 rotates.

Figure 13:
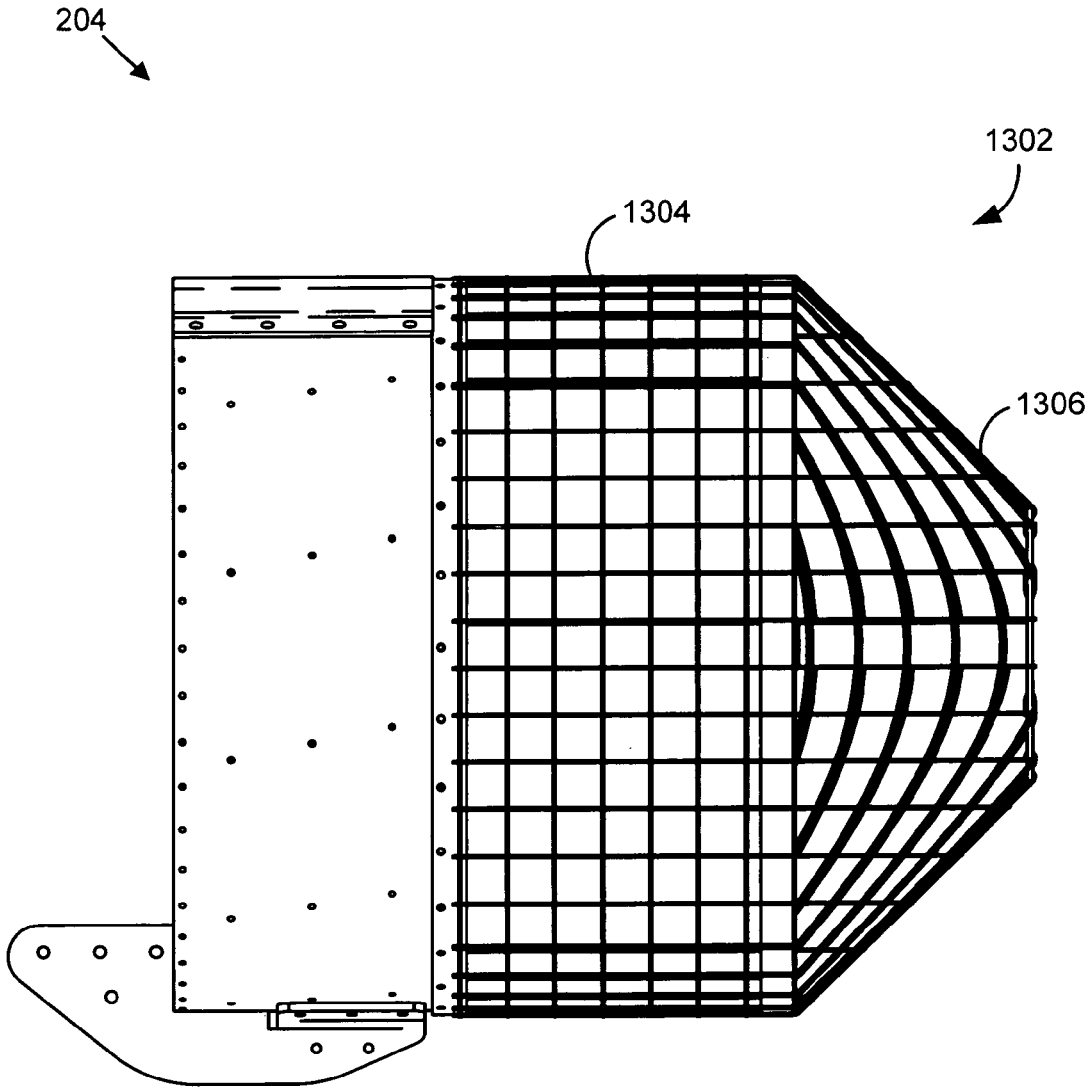
FIGS. 13 and 14 are diagrams illustrating an alternative embodiment of the shroud having an extended conical screen in accordance with the present invention.
Figure 14:
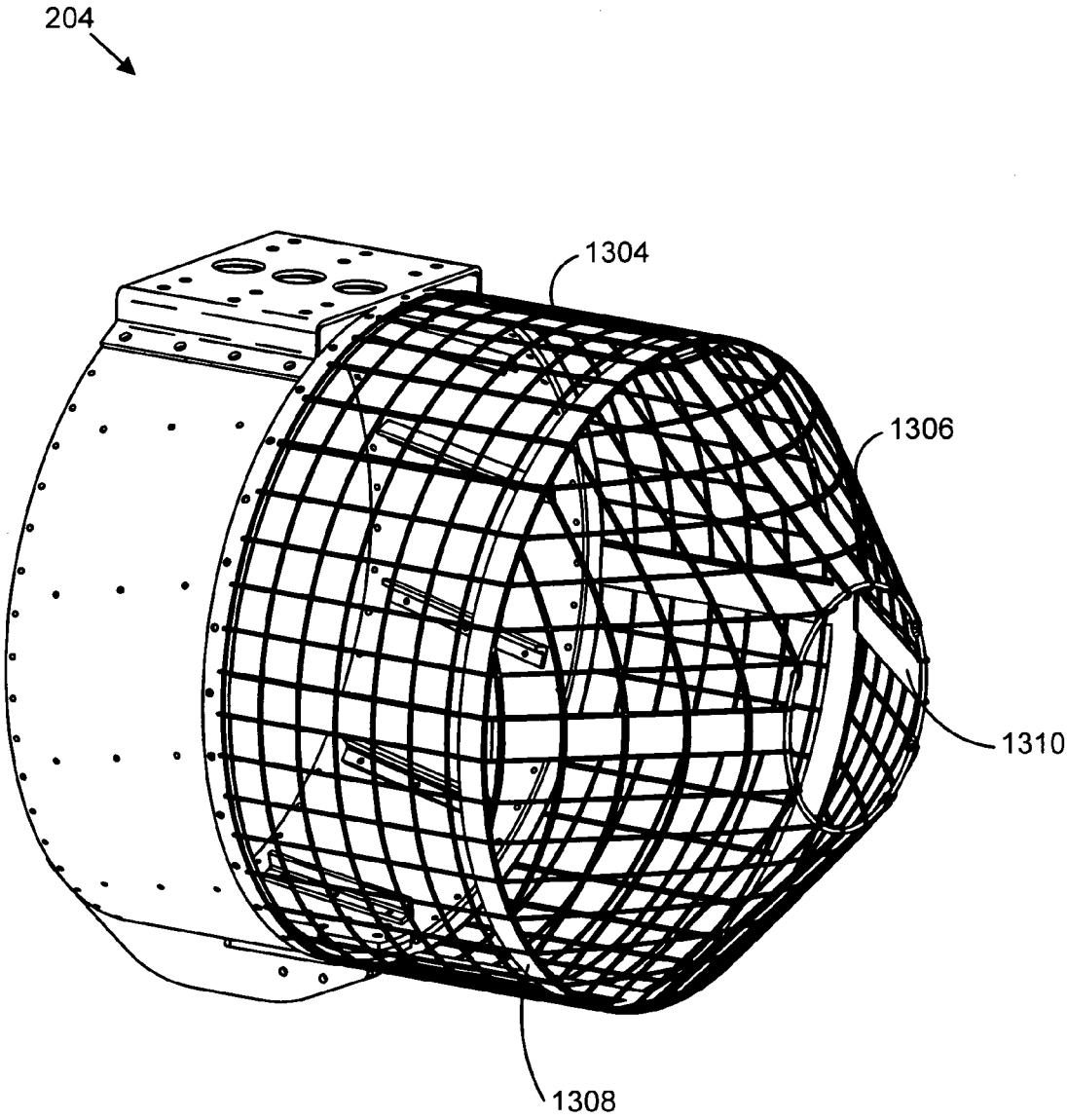

FIGS. 13 and 14 are diagrams illustrating an alternative embodiment of the shroud 204 having an extended conical screen 1302 in accordance with the present invention. In one embodiment, the extended conical screen 1302 is configured to accommodate dual prop setups as described above with reference to FIG. 12. The extended conical screen 1302 may comprise a substantially cylindrical mesh area connected with a conical area 1306. A support ring 1308 may be utilized to provide support to the cylindrical mesh area 1304 and the conical area 1306.

In a further embodiment, the support ring 1308 couples the cylindrical mesh area 1304 with the conical area 1306. The three pieces of the extended conical screen 1302 may be welded together and subsequently welded or attached to the shroud 204. A support bar 1310 similar to the support bar 1008 as described with reference to FIG. 10 may likewise be implemented to increase the strength of the extended conical screen 1302.

The cylindrical mesh area 1304 is configured to extend slightly beyond the second propeller of the dual propeller setup of FIG. 12 while still protecting vegetation and animal life from coming in contact with one or both propellers.

Figure 15:
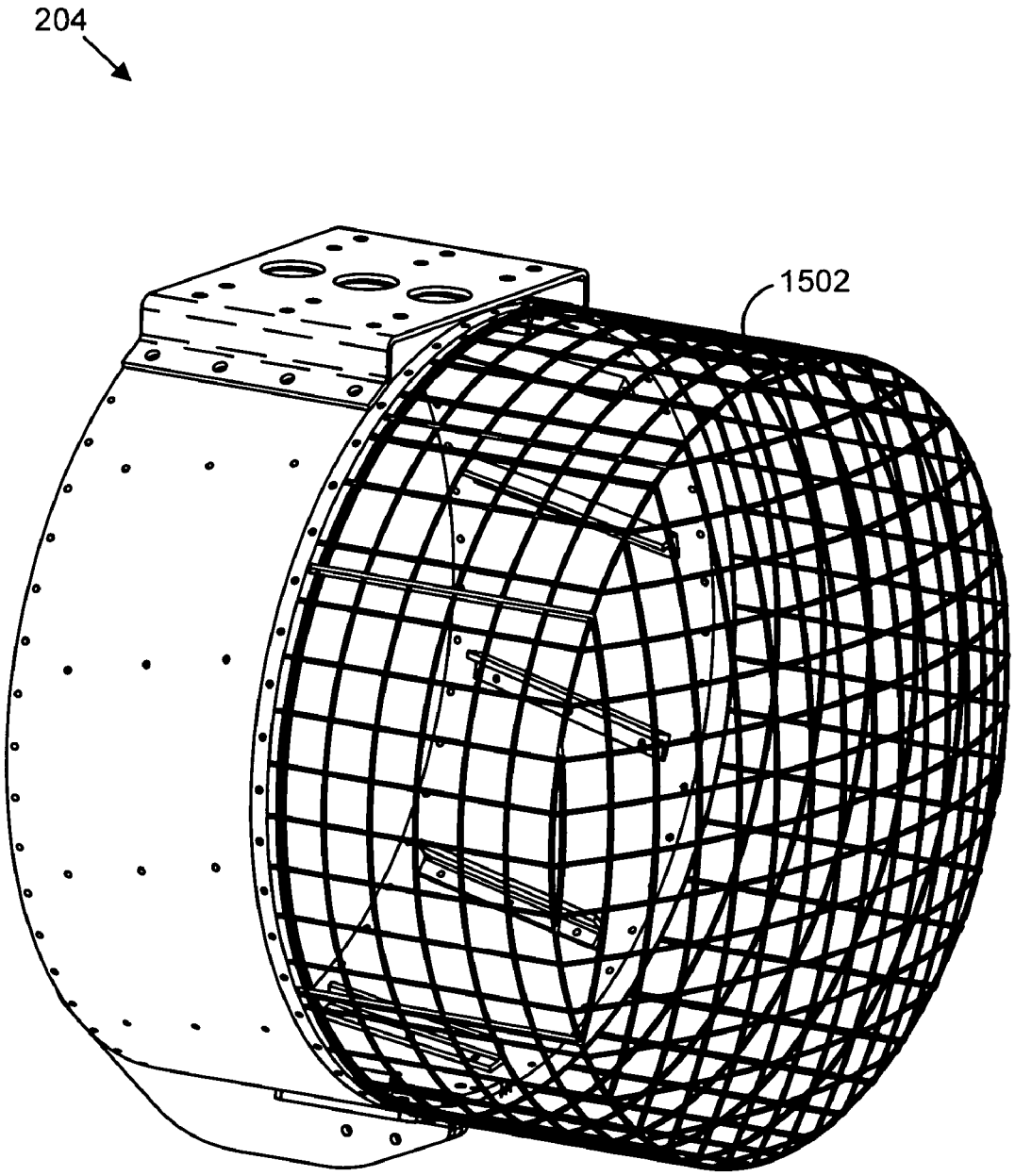
FIG. 15 is a perspective view diagram illustrating one embodiment of the shroud having a closed ended extended screen in accordance with the present invention.

FIG. 15 is a perspective view diagram illustrating one embodiment of the shroud 204 having a closed ended extended screen 1502 in accordance with the present invention. In one embodiment, the screen 1502 is configured to extend outward past the second propeller 1202. The screen 1502 may be formed of a metal, such as stainless steel. The mesh 1502 together with the shroud 204 substantially enclose the propellers and prevent vegetation, animal, marine, or human life from coming in contact with either the first or second propeller.

Figure 16:
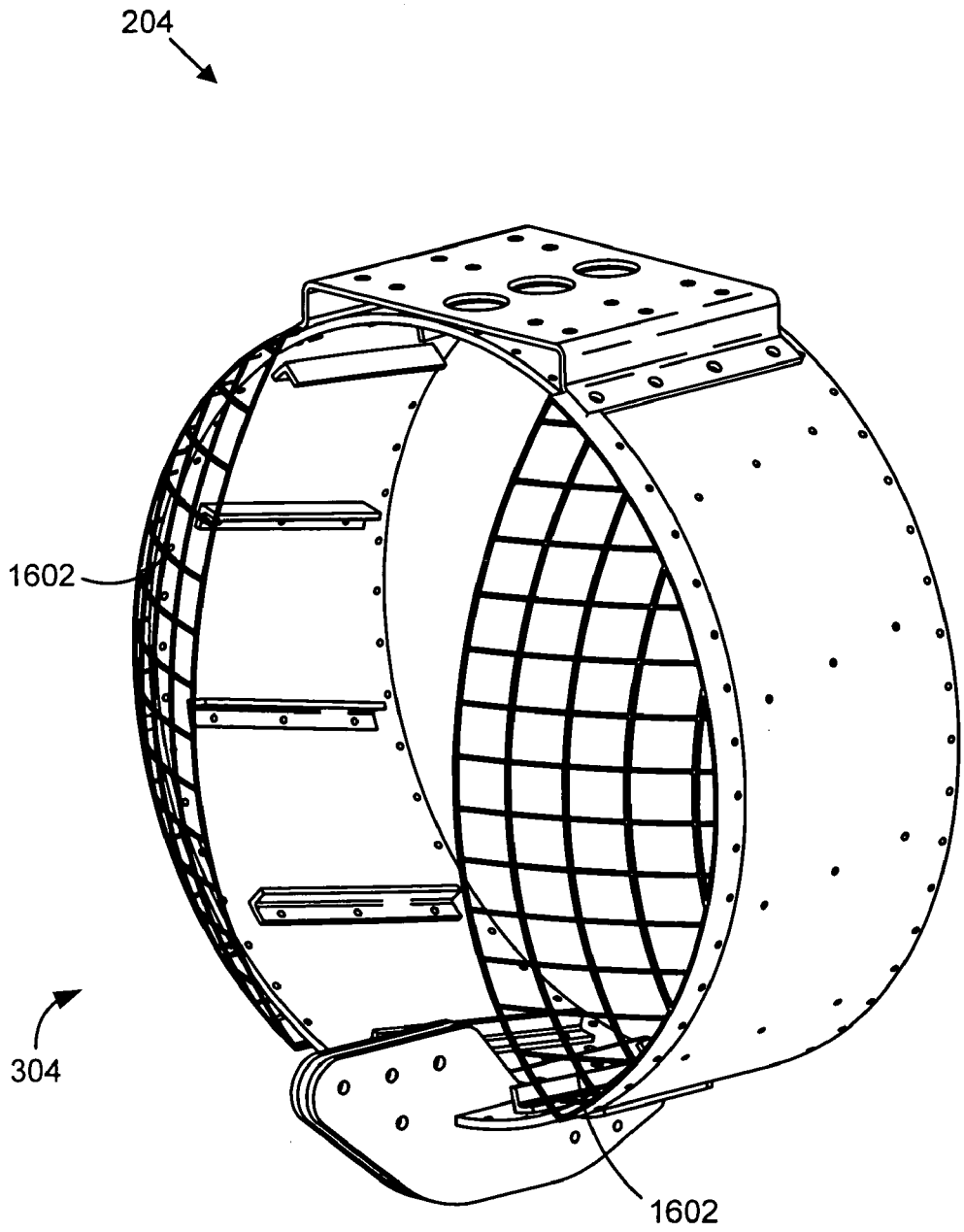
FIG. 16 is a perspective view diagram illustrating one embodiment of the shroud having a screen connected with the first opening of the shroud in accordance with the present invention.

FIG. 16 is a perspective view diagram illustrating one embodiment of the shroud having a screen 1602 connected with the first opening of the shroud in accordance with the present invention. In one embodiment, the shroud 204 may be configured with a screen 1602 coupled to the first or "fore" opening of the shroud 204. The screen 1602 may be convex in shape and formed of a rigid material as described above with reference to FIG. 11. However, the depicted screen 1602 is configured with an opening for receiving the stem drive of a boat. The screen 1602, in one embodiment, is configured to prevent objects from being sucked into the shroud 204 while not restricting the flow of water into the shroud 204.

Figure 17A:
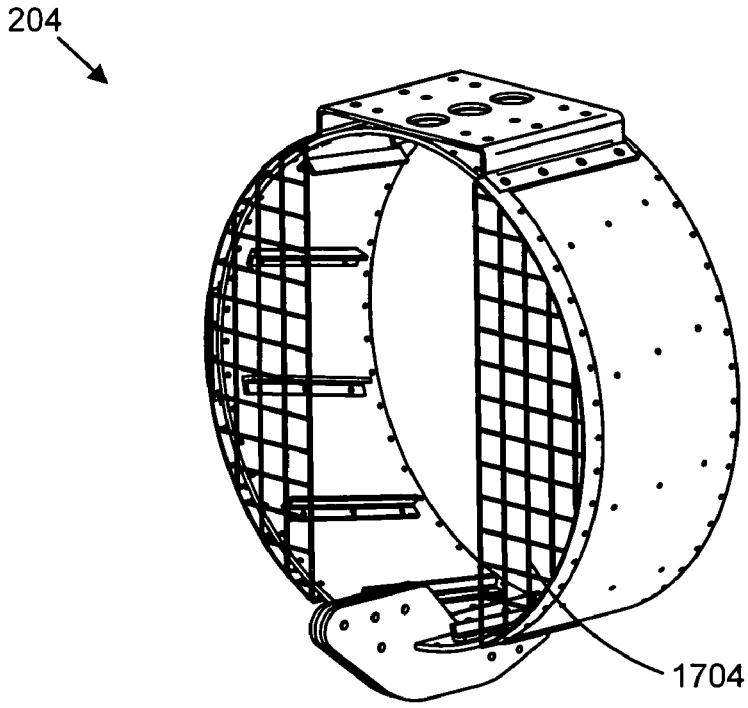
FIGS. 17*a* and 17*b* are perspective view diagrams illustrating alternative embodiments of screens capable of being attached to the fore opening of the shroud in accordance with the present invention.
Figure 17B:
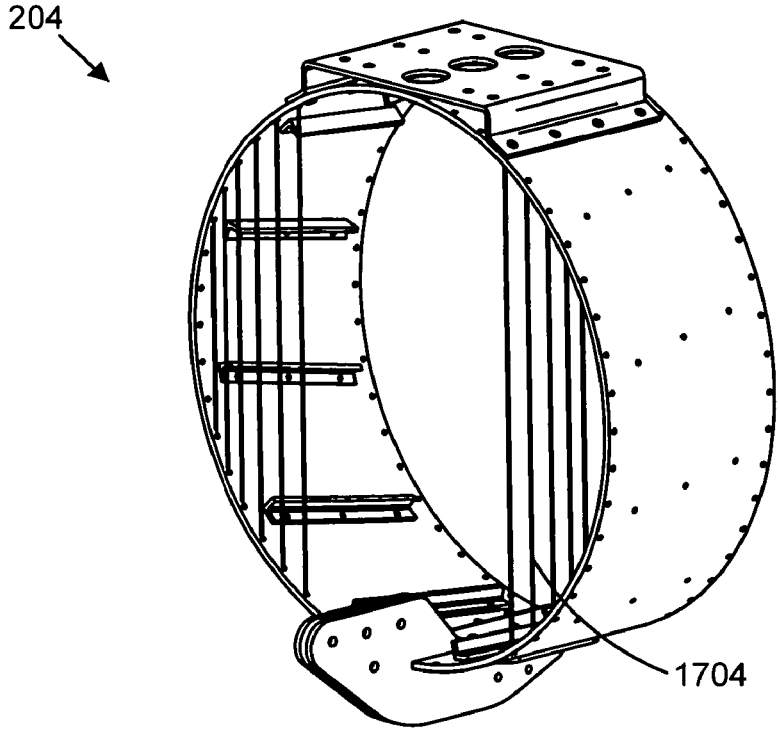

FIGS. 17*a* and 17*b* are perspective view diagrams illustrating alternative embodiments of screens capable of being attached to the fore opening of the shroud 204. Referring to FIG. 17*a*, the screen 1702 may be a non-curved screen formed of a woven metal material and welded to the shroud 204. Alternatively, strings 1704 may be stretched across the opening, as depicted in FIG. 17*b*, in order to prevent objects from being drawn into the shroud 204.

Figure 18:
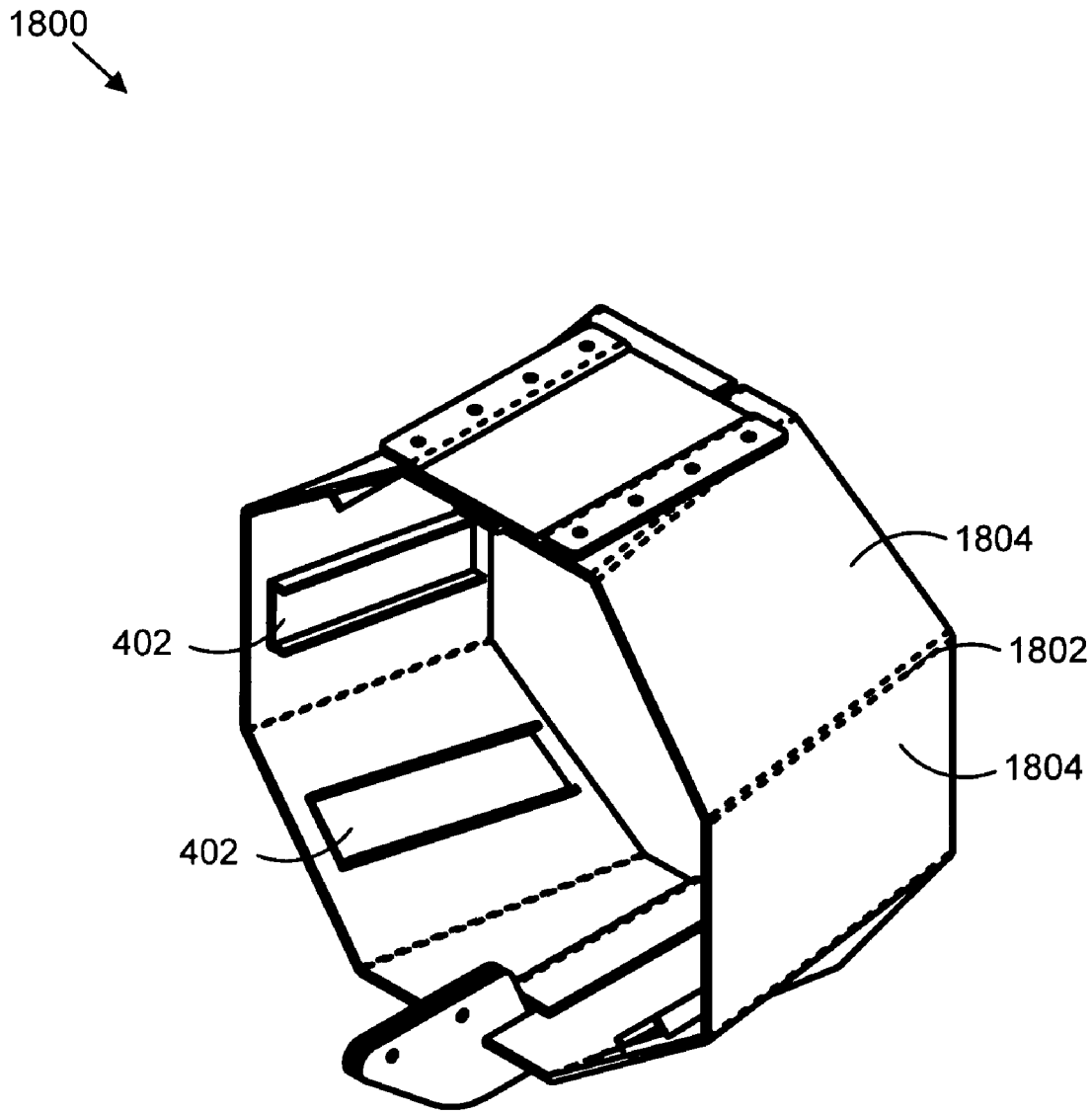
FIG. 18 is a perspective view diagram illustrating one embodiment of a shroud in accordance with the present invention.

FIG. 18 is a perspective view diagram illustrating one embodiment of a shroud 1800 in accordance with the present invention. In one embodiment, the shroud 1804 may be formed in a polygonal shape instead of a substantially cylindrical shape. In a further embodiment, the shroud 1800 may be formed as an octagon, as depicted in FIG. 18.

The joints 1802 or intersections between planes 1804 of the octagon are configured to aid the diverters 402 in directing water to form a vortex as the water leaves the shroud 1800. Such a "twisted octagon" shape utilizes the support structure of the shroud 1800 to increase the vortex and subsequently the performance of the boat.

Figure 19A:
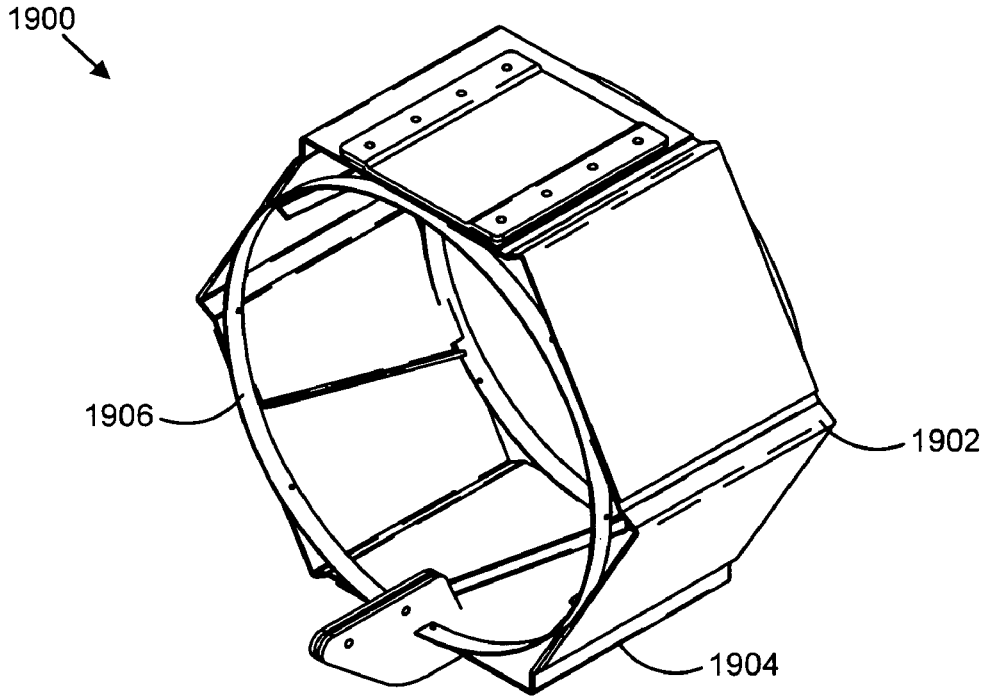
FIG. 19*a* is a perspective view diagram illustrating an alternative embodiment of a shroud having "fluted" joints in accordance with the present invention.

FIG. 19*a* is a perspective view diagram illustrating an alternative embodiment of a shroud 1900 having "fluted" joints in accordance with the present invention. In one embodiment, the shroud 1900 may be formed in the shape of a hexagon. Alternatively, the shroud may be formed in the shape of any polygon. One benefit of increasing the number of sides of the shroud 1900 is the increased number of joints 1902 to aid in the formation of the vortex.

The shroud 1900 may be formed by bending a rectangular piece of rigid material into a hexagon, as depicted. Additional "bends" 1904 maybe implemented at each joint 1902 in order to increase the cross sectional surface area between the outer shroud 1900 and an inner support ring 1906. Increasing the cross sectional surface area enables greater water flow through the "flute" and increases the vortex formation, thereby increasing performance.

Figure 19B:
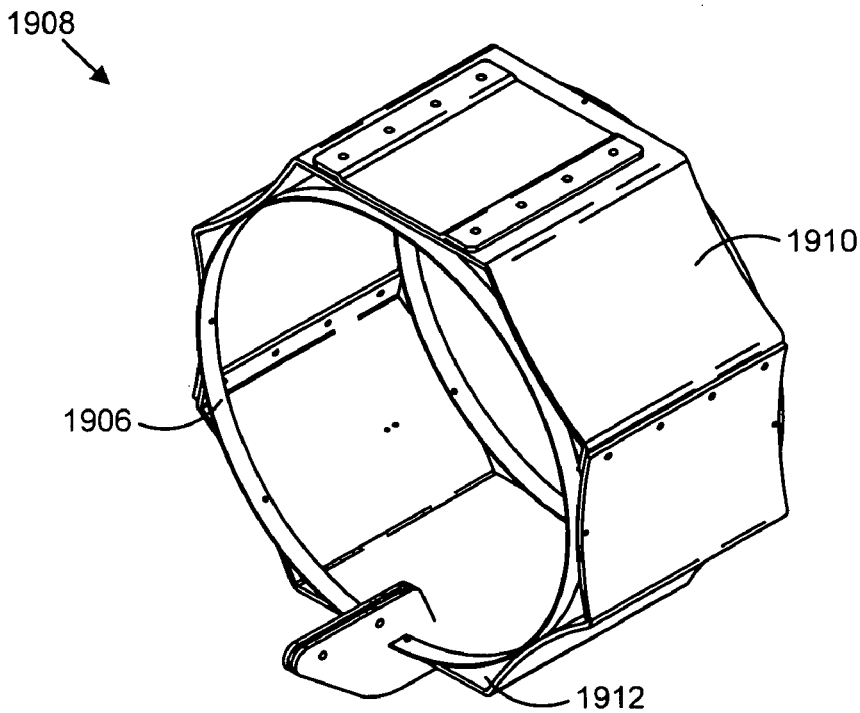
FIG. 19*b* is a perspective view diagram illustrating an alternative embodiment of the shroud having fluted joints in accordance with the present invention.

FIG. 19*b* is a perspective view diagram illustrating an alternative embodiment of the shroud 1908 having fluted joints in accordance with the present invention. In one embodiment, the shroud 1908 is formed with concave, or inward curving sides 1910 of the polygon, in this example an octagon. The inward curving surfaces server to increase the cross sectional area between the shroud 1908 and the support ring 1906 thereby increasing the amount of water which may flow through the flute 1912.

Figure 20:
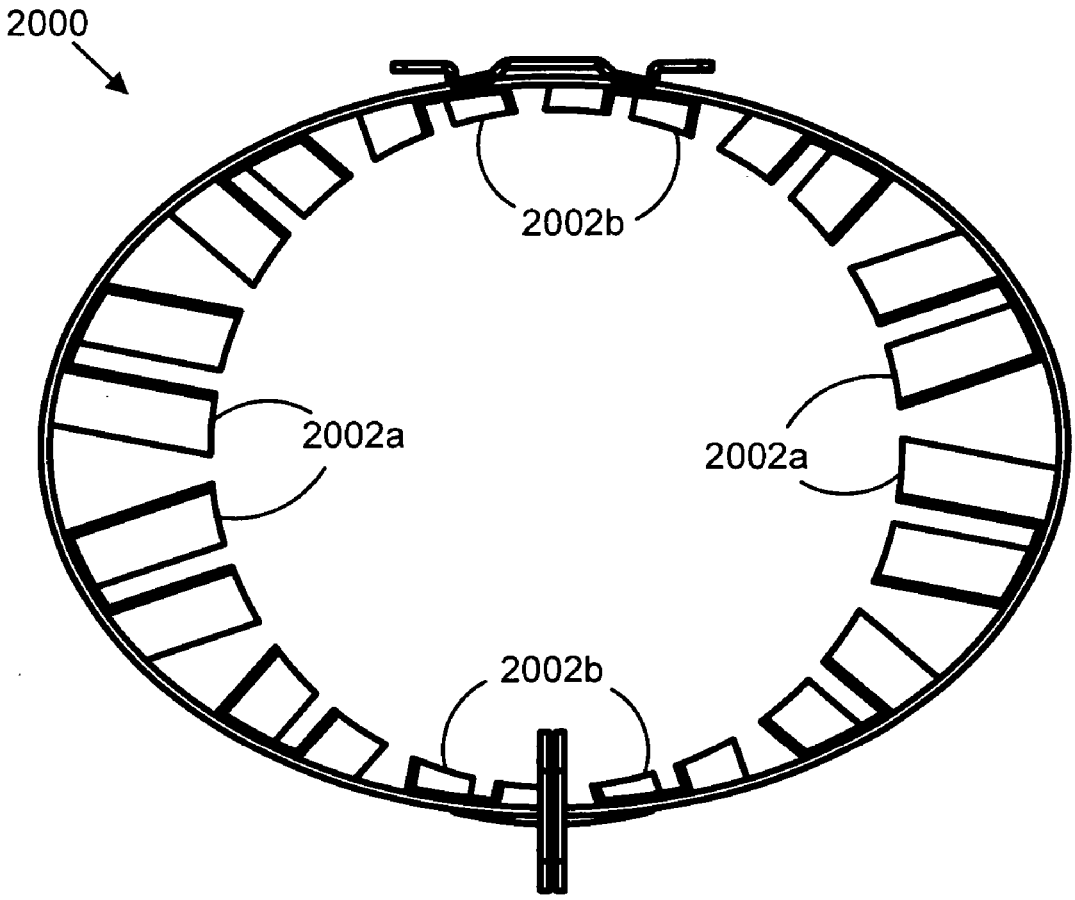
FIG. 20 is a schematic block diagram illustrating one embodiment of a shroud formed in a shape substantially similar to that of an ellipse in accordance with the present invention.

FIG. 20 is a schematic block diagram illustrating one embodiment of a shroud 2000 formed in a shape substantially similar to that of an ellipse in accordance with the present invention. In one embodiment, the shroud 2000 is configured having a plurality of diverters 2002. The diverters 2002 may be of varying heights, with diverters 2002*a* nearest the major axis (not shown) having the greatest height. Similarly, diverters 2002*b* nearest the minor axis (not shown) may have the lowest height.

Due to the limited and fixed space between a cavitation plate and a skeg, one way to increase the amount of water that may flow through a diverter is to extend the shroud 2000 outward horizontally. In one embodiment, extending outward laterally forms an elliptical shape and allows for the diverters 2002 of varying heights as described above.

Figure 21:
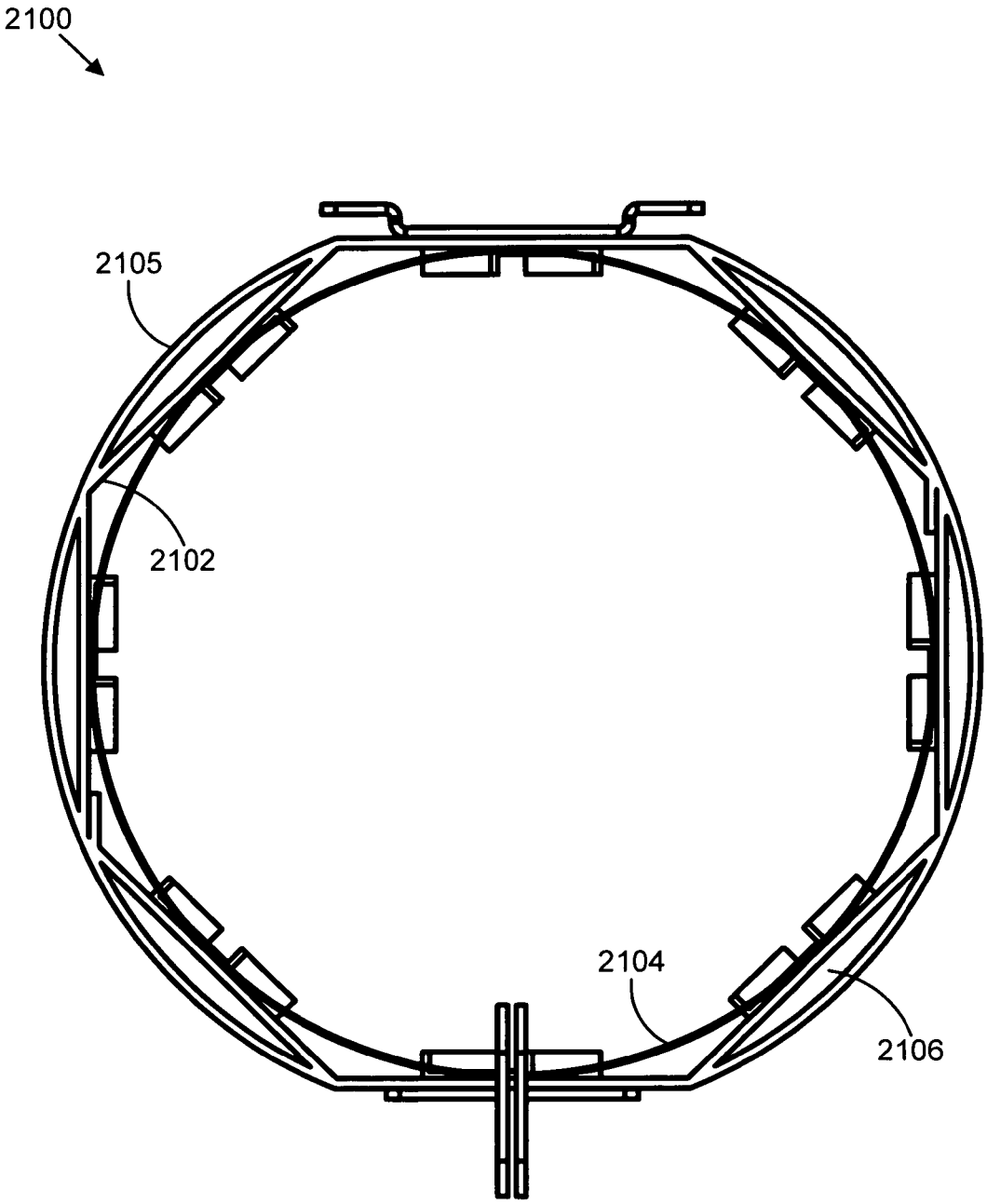
FIG. 21 is a schematic block diagram illustrating one embodiment of a shroud having a combination polygon/cylinder shroud in accordance with the present invention.

FIG. 21 is a schematic block diagram illustrating one embodiment of a shroud 2100 having a combination polygon/cylinder shroud. In one embodiment, the shroud 2100 may be configured with an inner polygonal shroud 2102. Furthermore, a support ring 2104 may also be implemented to increase the strength of the shroud 2100.

Very high horsepower engines, such as those found in racing boats, create immense amounts of pressure inside the shroud 2100. The combination polygonal/cylindrical shroud 2100 is configured to withstand such pressure. Additionally, the cylindrical portion 2105 together with the polygonal portion 2102 form a plurality of flutes 2106 or openings through which water may flow. By twisting the polygonal portion 2102 the flutes may be configured to direct water to form a vortex. In one embodiment, the polygonal portion 2102 is an octagon, however any number of different sides may be implemented.

Figure 22:
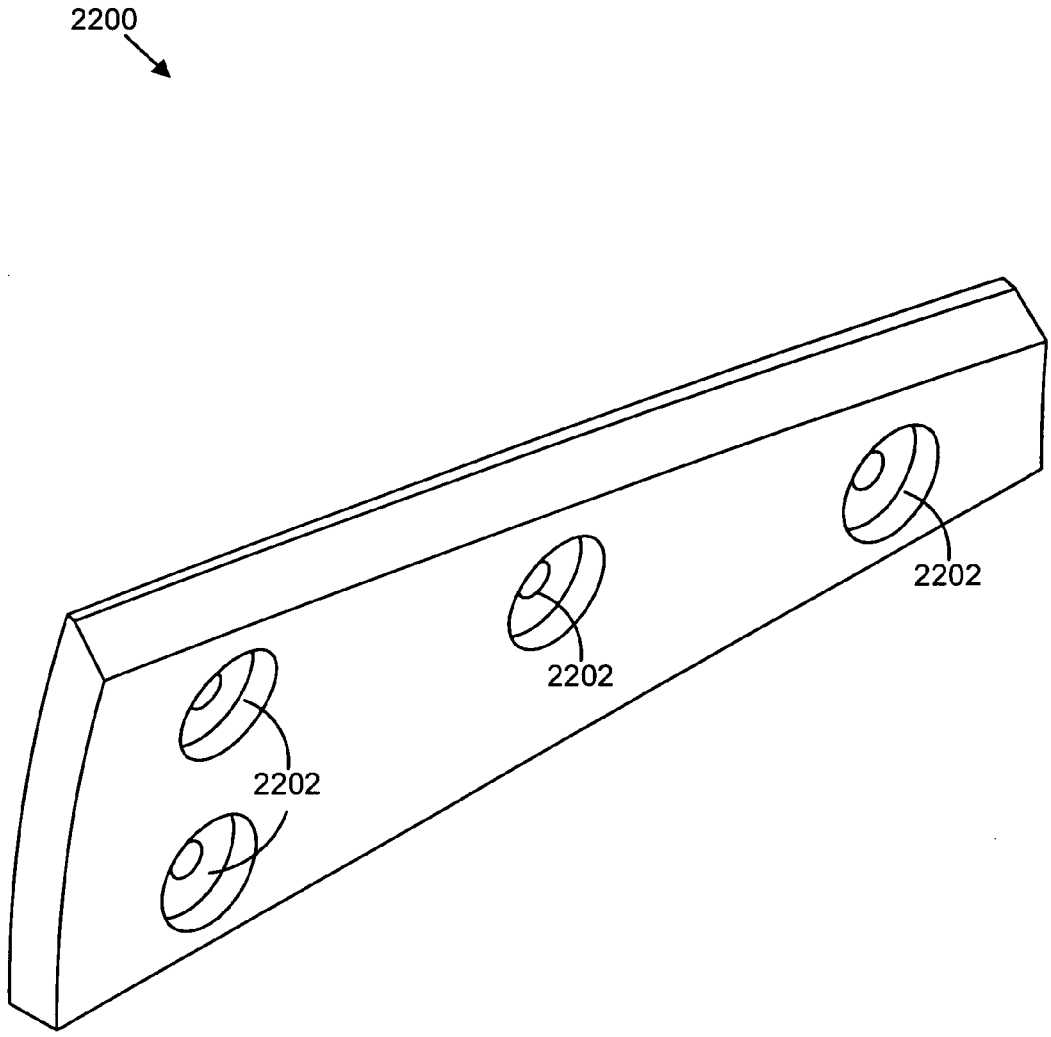
FIG. 22 is a perspective view diagram illustrating an alternative embodiment of a diverter in accordance with the present embodiment.

FIG. 22 is a perspective view diagram illustrating an alternative embodiment of a diverter 2200 in accordance with the present embodiment. In one embodiment the diverter 2200 is configured as a solid wedge shaped member formed of a semi-rigid material. The diverter 2200 is formed having a shape configured to interface with the interior surface of the shroud 204, and flush mount with the shroud 204. The diverter 2200 may be implemented with a plurality of holes 2202 configured to receive fasteners for coupling the diverter 2200 to the shroud 204. In one embodiment, the fasteners comprise rivets, screws, spot welds, etc. The diverter 2200 is configured with a shape selected to optimally direct water to form a vortex as the water exits the shroud 204 as described above with reference to FIGS. 6*a* and 6*b*.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for directing fluid from a hydro-drive device, the apparatus comprising:

a shroud having a first opening for the ingress of water, and a second opening for the egress of water;

a diverter connected with the shroud and angled in a direction selected to direct water to form a vortex as the water exits the shroud; and a screen connected with the second opening and configured to allow a substantially free flow of water and to prevent marine, plant, animal, and human life from contacting the hydro-drive device.

2. The apparatus of claim 1, wherein the screen is formed substantially from a semi-rigid material selected from the group consisting of metal-based mesh, polymer-based mesh, composite-based mesh, and ceramic-based mesh.

3. The apparatus of claim 1, wherein the screen is formed substantially from a flexible polymeric material.

4. The apparatus of claim 1, wherein the screen is configured to completely cover the second opening while allowing the substantially free flow of water.

5. The apparatus of claim 1, wherein the screen further comprises a collar configured to form an opening in the screen so as to allow objects to exit the shroud.

6. The apparatus of claim 1, wherein the screen is formed having a conical shape extending outward from the shroud.

7. The apparatus of claim 1, wherein the screen is formed having a convex shape extending outward from the shroud.

8. The apparatus of claim 1, wherein the screen is formed having a cylindrical shape extending outward from the shroud configured to prevent marine, plant, animal, and human life from contacting a second hydro-drive device.

9. The apparatus of claim 8, wherein the screen further comprises a conical screen portion coupled with the cylindrical shape.

10. The apparatus of claim 1, further comprising a mounting plate coupled to an outside surface of the shroud, the mounting plate configured to couple the shroud to a vehicle.

11. The apparatus of claim 1, further comprising a skeg coupler connected to the exterior surface of the shroud, the skeg coupler configured to slidably couple to a skeg of the marine vehicle.

12. The apparatus of claim 1, further comprising a second screen coupled with the first opening of the shroud configured to prevent objects from being drawn into the shroud.

13. The apparatus of claim 12 wherein the second screen partially covers the first opening.

14. The system of claim 13, wherein the screen is formed substantially from a semi-rigid material selected from the group consisting of metal-based mesh, polymer-based mesh, composite-based mesh, and ceramic-based mesh.

15. The system of claim 13, wherein the screen is formed substantially from a flexible polymeric material.

16. The system of claim 13, wherein the screen is configured to completely cover the second opening while allowing the substantially free flow of water.

17. The system of claim 13, wherein the screen further comprises a collar configured to form an opening in the screen so as to allow objects to exit the shroud.

18. The system of claim 13, wherein the screen is formed having a conical shape extending outward from the shroud.

19. The system of claim 13, wherein the screen is formed having a convex shape extending outward from the shroud.

20. The system of claim 13, wherein the screen is formed having a cylindrical shape extending outward from the shroud configured to prevent marine, plant, animal, and human life from contacting a second hydro-drive device.

21. The system of claim 19, wherein the screen further comprises a conical screen portion coupled with the cylindrical shape.

22. The system of claim 13, further comprising a mounting plate coupled to an outside surface of the shroud, the mounting plate configured to couple the shroud to a vehicle.

23. The system of claim 13, further comprising a skeg coupler connected to the exterior surface of the shroud, the skeg coupler configured to slidably couple to a skeg of the marine vehicle.

24. The system of claim 13, further comprising a second screen coupled with the first opening of the shroud configured to prevent objects from being drawn into the shroud.

25. A system for directing fluid from a hydro-drive device, the system comprising:

a motor;

a hydro-drive device coupled to the motor;

a shroud having a first opening for the ingress of water, and a second opening for the egress of water;

a diverter connected with the shroud and angled in a direction selected to direct water to form a vortex as the water exits the shroud; and a screen connected with the second opening and configured to allow a substantially free flow of water and to prevent marine, plant, animal, and human life from contacting the hydro-drive device.

26. An apparatus for directing fluid from a hydro-drive device, the apparatus comprising:

a shroud having a first opening for the ingress of water, and a second opening for the egress of water;

a diverter or diverters connected with the shroud and angled in a direction selected to direct water to form a vortex as the water exits the shroud;

a screen connected with the second opening and configured to allow a substantially free flow of water and to prevent marine, plant, animal, and human life from contacting the hydro-drive device;

the screen further comprising a collar configured to form an opening in the screen so as to allow objects to exit the shroud a mounting plate configured to connect the shroud to a surface of a vehicle; and a skeg coupler connected to an exterior surface of the shroud, the skeg coupler configured to slidably couple to a skeg of the marine vehicle.

* * * * *